US006486760B2

(12) United States Patent
Miyazaki et al.

(10) Patent No.: US 6,486,760 B2
(45) Date of Patent: Nov. 26, 2002

(54) ELECTROMAGNETIC RELAY

(75) Inventors: Katsuji Miyazaki, Mie (JP); Tsutomu Shimomura, Osaka (JP); Toyotaka Nishikawa, Mie (JP); Masaru Tsuji, Mie (JP); Masakatsu Makino, Hokkaido (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/455,323

(22) Filed: Dec. 6, 1999

(65) Prior Publication Data

US 2002/0050883 A1 May 2, 2002

(30) Foreign Application Priority Data

Dec. 7, 1998 (JP) ..... 10-346749
Jun. 25, 1999 (JP) ..... 11-180922

(51) Int. Cl.[7] ..... H01H 51/22
(52) U.S. Cl. ..... 335/78; 335/80; 335/129
(58) Field of Search ..... 335/78–80, 124, 335/128, 129, 130, 131, 133, 281, 282, 297; 336/216

(56) References Cited

U.S. PATENT DOCUMENTS 4,614,927 A * 9/1986 Mikami et al. ..... 335/78
4,801,908 A * 1/1989 Weaver ..... 335/80
5,049,845 A * 9/1991 Yokoyama et al. ..... 335/133
5,392,015 A * 2/1995 Matsuoka et al. ..... 335/78
5,886,601 A 3/1999 Kitamura et al.
5,921,134 A 7/1999 Shiba et al.

FOREIGN PATENT DOCUMENTS

| | | |
|---|---|---|
| DE | 1606050 | 4/1949 |
| DE | 19546763 | 6/1997 |
| DE | 19602642 | 7/1997 |
| EP | 0272616 | 6/1988 |
| EP | 0751544 | 1/1997 |
| FR | 1543930 | 10/1968 |
| JP | 4322027 | 11/1992 |
| JP | 8138624 | 12/1997 |
| JP | 10-92285 | * 4/1998 |

OTHER PUBLICATIONS

An English Language abstract of DE 196 02 642. 7/97.
An English Language abstract of JP 4–322027. 11/92.
An English Language abstract of JP 8–138624. 12/97.
English Language Abstract of Japanese Patent Publication JP 09 314255 A, published Dec. 9, 1997.

* cited by examiner

*Primary Examiner*—Lincoln Donovan
*Assistant Examiner*—Tuyen T. Nguyen
(74) *Attorney, Agent, or Firm*—Greenblum & Bernstein, P.L.C.

(57) ABSTRACT

An electromagnet includes a plate-like yoke, shaped like L, with a curved surface portion, a rectangular iron core connected to said yoke and wound by a coil, an armature rotatably and pivotally supported by one end of said yoke, said armature being driven by said coil and coupling device for coupling said yoke with said iron core by spin press-fitting.

24 Claims, 37 Drawing Sheets

PRIOR ART

PRIOR ART

PRIOR ART

PRIOR ART

PRIOR ART

ELECTROMAGNETIC RELAY

BACKGROUND OF INVENTION

1. Field of Invention

The present invention relates to an electromagnetic relay in a type of "slim type relay".

2. Related Art

FIG. 1 is a perspective view showing an electromagnet used in a conventional electromagnetic relay. In the electromagnet fixing structure shown in this figure, a yoke 1011, shaped like L, includes a bent surface portion 111. A rectangular through hole 112 is formed in the bent surface portion 111. A rod-like iron core 1082 is configured such hat one end of the iron core is somewhat smaller in cross section than the rectangular through hole 1112, and the other end is provided with a flange 1122. One end of the iron core 1082 is inserted into the through hole 1112, thereby fixing the yoke 1011 and the iron core 1082. The yoke 1011 and the iron core 1082 in the an electromagnet fixing structure are used together with a coil block 1013 which includes a cylindrical bobbin 1131 on which a coil 1132 is wound and a pair of coil terminals 1133 electrically connected to the coil 1132, whereby an electromagnet is formed.

FIG. 2 is an exploded perspective view showing another conventional electromagnet, and FIG. 3 is a perspective view showing the electromagnet shown in FIG. 2. In the electromagnet fixing structure shown in FIG. 2, a piece 1091, shaped like L, includes a bent surface portion 1111. A rectangular through hole 1912 is formed in the bent surface portion 1911. An iron core 1092 is shaped like L: one end of the iron core is somewhat larger in cross section than the through hole 1912 and the other end is bent. One end of the iron core 1092 is inserted into the through hole 1912, thereby fixing the yoke 1091 and the iron core 1092. The yoke 1091 and the iron core 1092 in the an electromagnet fixing structure, as shown in FIGS. 2 and 3, are used together with a coil block 1023 which includes a cylindrical bobbin 1231 on which a coil 1232 is wound and a pair of coil terminals 1233 electrically connected to the coil 1232, whereby an electromagnet is formed.

A metal member fixing method which can fix a metal member without generating metallic powder by plastically deforming a metal member with a press-fitting punch having a spherical end is disclosed JP-A-9-314255.

In a thin-type electromagnetic relay which is high in electrical insulation and small in mounting area, an armature is generally separated from a contact block in order to secure a high electrical insulation. As a result, a card to drive a contact spring by the armature is long, and a weight of a movable portion is increased. Since its structure is designed to be thin, the coil block is also thin, so that a magnetic efficiency of the resultant electromagnetic relay is lower than that of the electromagnetic relay using a circular electromagnet.

To solve such a problem, it is necessary to improve a contact opening/closing ability as possible by increasing a contact pressure since a contact chamber is designed with an intention of space saving. To this end, it is necessary to increase an attraction force by the electromagnet. To increase the attraction force, it is desirable to reduce a magnetic resistance in a coupling portion of the iron core with the yoke where the largest magnetic loss occurs. For this reason, a called spin press-fitting is conventionally employed.

In the an electromagnet fixing structure for the yoke and the iron core shown in FIGS. 1 to 3, as seen from a cross sectional view shown in FIG. 4, it is difficult to manage the protruded portions (portion A in FIG. 4A) of the iron core protruded from the surface of the yoke. That is, the protruded portions of the iron cores from the yoke surfaces are not uniform in dimension. If the protruded portions of the iron cores vary in dimension, as shown in FIG. 1, the portions on both sides of the through hole in the bent surface (both sides in FIG. 1) are expanded to be deformed when the spin press-fitting is carried out. As a result, sometimes a gap is created (left) between the yoke and the iron core.

Further, in this structure, sometimes the iron core is tilted at the time of spin press-fitting, so that the exact positioning is not exact. In this case, the magnetic coupling is weakened, so that the attraction force by the electromagnet is reduced in magnitude.

FIGS. 5 through 7 show another example of a conventional electromagnetic relay. The electromagnetic relay is made up of 1) an electromagnetic block which includes an electromagnet 1201 formed such that a coil 1204 is wound on a coil bobbin 1203 with an iron core 1202 inserted into the central part of the coil bobbin, a yoke 1205', shaped like U, integrally formed with an upright portion 1205*a*' magnetically coupled to a first magnetic pole 1201*a* of the electromagnet 1201 and a lateral portion 1205*b*+ extending from an end of the upright portion 1205*a*' to a position near a second magnetic pole 1201*b* of the electromagnet 1201, 2) an armature 1206 which is disposed facing the second magnetic pole 1201*b* of the electromagnet 1201 and rotatable about the end of the yoke 1205', and 3) a hinge spring 1208 for rotatably supporting the armature 1206 which the hinge spring is fixed at one end to the lateral portion 1205*b*', of the yoke 1205' and at the other end to the armature 1206, a card 1207 which is fixed to the free end of the armature 1206 and translates with the turning of the armature 1206, 4) a pair of fixed contact plates 1209 and 1210 which are fastened at first ends to fixed contacts 1209*a* and 1210*a* which are oppositely disposed, 5) a movable contact plate 1211 with movable contacts 1211*a* fastened on both sides of one end thereof, which the movable contact plate is turned with the translation of the card 1207, the movable contacts 11*a* being brought into contact with and separated from the fixed contacts 1209*a* and 1210*a, 6*) a base 1215, made of insulating synthetic resin, including fixed contact plates 1209 and 1210 and the movable contact plate 211 being provided at a first end of the base 1215, and the electromagnetic block being provided on the other end, 7) external terminals 1212 which are electrically connected to the fixed contact plates 1209 and 1210 and the movable contact plate 1211, while protruding from the underside of the base 1215, 8) a terminal support 1213, made of synthetic resin, for supporting coil terminals 1214 connected to the coil 1204 located under the armature 1206, and 9) a case 1216, shaped like a box, which is attached to the electromagnetic block and the base 1215 in a state that the external terminal 1212 and the coil terminals 1214 are projected to exterior.

An operation of the thus constructed electromagnetic relay will be described. In a stationary sate in which no voltage is applied to between the coil terminals 1214, no attraction force by the electromagnet 1201 is present. In this state, the armature 1206 is held at a position (referred to as "stationary position") located apart from the second magnetic pole 1201*b* of the electromagnet 1201. The movable contact plate 1211 is disposed on the base 1215 so as to press the movable contacts 1211*a* against the fixed contact 1209*a*, which is located close to the electromagnetic block (the normally closed side). Accordingly, when the armature 1206 is at the stationary position, the card 1207 has been moved to the left in FIG. 5. And the movable contact plate 1211 is not pressed by the end of the card 1207. Therefore, the movable contacts 1211*a* is held in a state that the movable contacts 1211*a* is in contact with the fixed contact 1209*a* on the normally closed side (this state will be (referred to as "stationary state"). Incidentally, a contact pressure between the movable contacts 1211*a* and the fixed contact 1209*a* is produced by a spring force of the movable contact plate 1211 made of elastic material.

When in a stationary state, a predetermined voltage (higher than a responsive voltage) is applied to between the coil terminals 1214, the armature 1206 that is attracted to the second magnetic pole 1201*b* of the electromagnet 1201 is turned about the end of the yoke 1205', while resisting the hinge spring 1208 and a spring force of the movable contact plate 1211, and is attracted to the second magnetic pole 1201*b*. In turn, the card 1207 is translated to the right in FIG. 5 by the turning of the armature 1206. The end of the card 1207 pushes the movable contact plate 1211 to turn in the right direction in FIG. 5. The movable contacts 1211a fastened to the movable contact plate 1211 moves apart from the fixed contact 1209*a* on the normally closed side and comes in contact with the fixed contact 1210*a*. As a result, the movable contact is switched to another fixed contact. When the voltage applied to between the terminals 1214 drops to below a release voltage, the armature 1206 that is released from the attraction by the electromagnet 1201 is returned to the stationary position with the aid with the spring forces of the hinge spring 1208 and the movable contact plate 1211. Since the pressure by the card 1207 is removed, the movable contact plate 1211 is returned to the stationary state, and the movable contact 1211*a* moves apart from the fixed contact 1210*a* and comes in contact with the fixed contact 1209*a* on the normally closed side. In this way, the movable contact is switched to another fixed contact.

When the electromagnetic relay is operating, the iron core 1202 and the yoke 1205' form a closed magnetic circuit. A contact area between the hinge spring 208 and the yoke 1205' at the end of the lateral portion 1205*b*' of the yoke 1205' serving as a fulcrum when the armature 1206 is turned, is small. Therefore, a magnetic resistance in this area is large, so that an attraction force of the electromagnet 1201 exerting armature 1206 reduces in magnitude.

Another conventional electromagnetic relay as shown in FIGS. 8 and 9 is known as this type of the electromagnetic relay. As shown, the electromagnetic relay is made up of electromagnetic block 1301 with an armature 1316, a card 1302, a contact portion 1303, a body 1304, and a cover 1305. The armature 316 of the electromagnetic block 1301 is reciprocatively driven when current is fed to a coil thereof.

The card 1302 is driven through the reciprocal motion of the armature 1316 to open and close a contact portion 1303 to be described later. The contact portion 1303 includes a normally closed contact plate 1330, made of conductive material, having a normally open contact 1330*a* at an end thereof, a normally open contact plate 1332, made of conductive material, having a normally open contact 1332*a* at an end thereof, and a movable contact plate 1331, made of conductive material, having movable contacts 1331*a* on both sides of one end thereof, which the contacts 1331*a* may be brought into contact with and separated from the normally open contact 1330*a* and the normally open contact 1332*a*. The body 1304, made of synthetic resin, includes contact plates 1330 to 1332 are located at one end when viewed in the longitudinal direction and accommodating grooves 1349*a* to 1349*c* located at the same end and opened to one side when viewed in the width direction. The body 1304 further includes an accommodating concavity portion 1342 for receiving the electromagnetic block 1301, which is located at the other end when viewed in the longitudinal direction and opened to the other side when viewed in the width direction. The cover 1305, shaped like a box, is made of synthetic resin, and opened at one side. The body 1304 is set covering the electromagnetic block 1301, the contact portion 1303 and the like.

The electromagnetic block 1301 is placed in the accommodating concavity portion 1342 with the armature 1316 being located in opposition to the contact portion 1303. The card 1302, shaped like a plate, includes engaging pawls 1321 at one end. The engaging pawls 1321 are brought into engagement with depressed parts 1316*a*, which are formed in both side edges of the extreme end of the armature 1316. The card 1302 further includes a pressing member 1322 at the other end. The pressing member 1322 is used for pressing the movable contact plate 1331. A protruded piece 1323 is provided at the extreme end of the pressing member 1322, and is to be inserted into a hole 1331*c* bored in an end of the movable contact plate 1331. The engaging pawls 1321 of the card 1302 are respectively brought into engagement with the depressed parts 1316*a*. The protruded piece 1323 of the pressing member 1322 is inserted into the hole 1331*c* of the movable contact plate 1331. The card 1302 is bridged between the armature 1316 and the movable contact plate 1331 while being confronted with a wall 1341 forming the ceiling of the accommodating concavity portion 1342. The width of the pressing member 1322 of the card 1302 is shorter than the width of the remaining portion thereof. The pressing member 1322 of the card 1302 is disposed closer to the side of the accommodating concavity portion 1342, which is opposite to the closed side thereof. Accordingly, there is no chance that the pressing member 1322 interferes with ribs 1305*a* and 1305*b*, which are protruded from the inner surface of the cover 1305. Those ribs will be described later.

In the electromagnetic relay, the contact plate 1330 to 1332 are disposed on one side of the body 1304 when viewed in the width direction, and the electromagnetic block 1301 is disposed on the other side. With this structure, a long insulation distance is secured between the contact portion 1303 and the electromagnetic block 1301, to thereby improve the insulating performance of the electromagnetic relay. Grooves 1344 and 1345 are formed in an insulation wall 1343, which separates the accommodating concavity portion 1342 from a space closer to the contact portion 1303. The grooves 1344 and 1345 extend along the opening edge of the accommodating concavity portion 1342. A couple of ribs 1305*a* and 1305*b* for receiving the grooves 1344 and 1345 are protruded from the inner surface of the cover 1305. Therefore, when the cover 305 is applied to the body 1304, the ribs 1305*a* and 1305*b* of the cover 1305 are inserted into the grooves 1344 and 1345, respectively, so that those ribs 1305*a* and 1305*b* insulate the electromagnetic block 1301 from the contact portion 1303.

When the electromagnetic relay is reduced in size, the shortest distance (indicated by "a" in FIG. 8B) is reduced which is measured along the surface of the wall 1341 located between the electromagnetic block 1301 and the contact portion 1303, and the surface of the card 1302. Therefore, there is a chance of failing to secure an insulation distance (creeping distance), which is required for providing a desired electrical insulation performance.

When the cover 1305 is attached to the body 1304, a height position of the cover 1305 with respect to the body

1304 is approximately determined when the lower ends of the ribs 1305*a* and 1305*b* protruded from the inner surface of the cover 1305 are brought into contact with the bottoms of the grooves 1344 and 1345. In this case, the positioning of them is not precise, however. For this reason, the height positions of the cover 1305 to the body 1304 are not uniform among the products of the electromagnetic relays.

SUMMARY OF INVENTION

Accordingly, an object of the present invention is to provide an electromagnet fixing structure of an electromagnetic relay which can increase an attraction force by an electromagnet, and a method of fixing the electromagnet.

Accordingly, another object of the present invention is to provide an electromagnetic relay which increases an attraction force of an electromagnet exerting on the armature without increase of cost, and a method of manufacturing an electromagnetic relay which is easy in managing the thick dimensions when the yokes are manufactured.

Accordingly, another object of the present invention is to provide an electromagnetic relay of which the insulation performance is improved. Another object of the present invention is to provide an electromagnetic relay in which the cover can precisely be positioned to the body.

According to an aspect of the present invention, there is provided an electromagnetic relay comprising:

a rectangular iron core with a coil wound thereon;

a plate-like yoke of which one end is magnetically coupled with one magnetic pole of said iron core and the other end is extended to a position near the other magnetic pole of said iron core, said other end of said yoke having an enlarge contact area increase surface shaped like L;

an armature rotatably and pivotally supported by said other end of said yoke;

a movable contact movable with a movement of said armature; and a fixed contact brought into contact with and separated from said movable contact.

According to another aspect of the present invention, there is provided a method of forming an electromagnetic relay including:

a rectangular iron core with a coil wound thereon;

a plate-like yoke of which one end is magnetically coupled with one magnetic pole of said electromagnet and the other end is extended to a position near the other magnetic pole of said electromagnet, said other end of said yoke having an enlarge contact area increase shaped like L;

an armature rotatably and pivotally supported by said other end of said yoke, said armature being driven by said coil; a movable contact being movable with a turn of said armature; and a fixed contact being brought into contact with and separated from said movable contact, said method comprising the steps of:

bending said other end of said yoke to have a shape like L; and shaving-machining said L-shaped portion to form a fulcrum of said armature when said armature is turned.

According another aspect of the present invention, there is provided an electromagnetic relay including:

a rectangular iron core with a coil wound thereon;

a plate-like yoke of which one end is magnetically coupled with one magnetic pole of said iron core and the other end is extended to a position near the other magnetic pole of said iron core, said other end of said yoke having an enlarge contact area increase surface shaped like L;

an armature rotatably and pivotally supported by said other end of said yoke, said armature being driven by said coil;

a movable contact being movable with a turn of said armature; and a fixed contact being brought into contact with and separated from said movable contact, said electric magnet prepared by the process comprising the steps of:

bending said other end of said yoke to have a shape like L; and shaving-machining said L-shaped portion to form a fulcrum of said armature when said armature is turned.

According to another aspect of the present invention, there is provided an electromagnet comprising:

a plate-like yoke, shaped like L, with a curved surface portion;

a rectangular iron core connected to said yoke and wound by a coil;

an armature rotatably and pivotally supported by one end of said yoke, said armature being driven by said coil; and coupling means for coupling said yoke with said iron core by spin press-fitting.

According to another aspect of the present invention, there is provided an electromagnet comprising:

a plate-like yoke, shaped like L, with a curved surface portion;

a rectangular iron core connected to said yoke and wound by a coil;

an armature rotatably and pivotally supported by one end of said yoke, said armature being driven by said coil; and coupling means for coupling said yoke with said iron core by spin press-fitting.

According to another aspect of the present invention, there is provided an electromagnet comprising:

an electromagnet assembly including:

a rectangular iron core with a coil wound thereon;

a plate-like yoke of which one end is magnetically coupled with one magnetic pole of said electromagnet and the other end is extended to a position near the other magnetic pole of said electromagnet, said other end of said yoke having an enlarge contact area increase shaped like L; and an armature rotatably and pivotally supported by said other end of said yoke;

a contact assembly including;

a movable contact movable through a movement of said armature;

a fixed contact brought into contact with and separated from said movable contact; and coupling means for coupling said yoke with said iron core by spin press-fitting.

According to another aspect of the present invention, there is provided an electromagnet further comprising:

a card for moving said movable contact through a movement of said armature; and a main body including contact plates at one end and an accommodating concavity portion opened sideways at the other end, said assembly being placed in said accommodating concavity portion, said main body including a ceiling wall with a protrusion.

According to another aspect of the present invention, there is provided an electromagnet relay, further comprising:

a box-like cover one of which is opened, said cover being attached to said main body while covering said electromagnet block, said contact portion, and said card; and a positioning member for keeping a distance between said ceiling wall of said main body and a wall of said cover at a fixed distance.

BRIEF DESCRIPTION OF DRAWINGS

FIG. 8A is a perspective view showing the electromagnetic relay before an electromagnetic block is assembled into a body; and FIG. 8B is a perspective view showing the electromagnetic relay after the electromagnetic block is assembled into the body.

FIG. 9 is a cross sectional view of the same when viewed from the front side.

FIG. 22A is an elevational sectional view of the same and FIG. 22B is a sectional side elevation of the same.

FIG. 26A is a perspective view showing the electromagnetic relay before an electromagnetic block is assembled into a body; and FIG. 26B is a perspective view showing the electromagnetic relay after the electromagnetic block is assembled into the body.

FIG. 27A is a cross sectional view showing the electromagnetic relay when viewed from the front side; FIG. 27B is a top view showing the same; FIG. 27C is a cross sectional view taken on line B—B; and FIG. 27D is a bottom view showing the same.

FIG. 30A is a cross sectional view showing a state of a normally closed contact plate being press fit; and FIG. 30B is a cross sectional view showing a state of a normally closed contact plate being press fit.

FIGS. 34A and 34B show an electromagnetic relay which is another embodiment of the present invention: FIG. 34A is a perspective view showing the electromagnetic relay before an electromagnetic block is assembled into a body; and FIG. 34B is a perspective view showing the electromagnetic relay after the electromagnetic block is assembled into the body.

FIG. 35A is a cross sectional view showing the electromagnetic relay when viewed from the front side; FIG. 35B is a top view showing the same; FIG. 35C is a cross sectional when viewed from the top; and FIG. 35D is a bottom view showing the same.

DETAILED DESCRIPTION OF PREFERRED EMBODIMENTS

Electromagnet Fixing Structure

Figure 1:
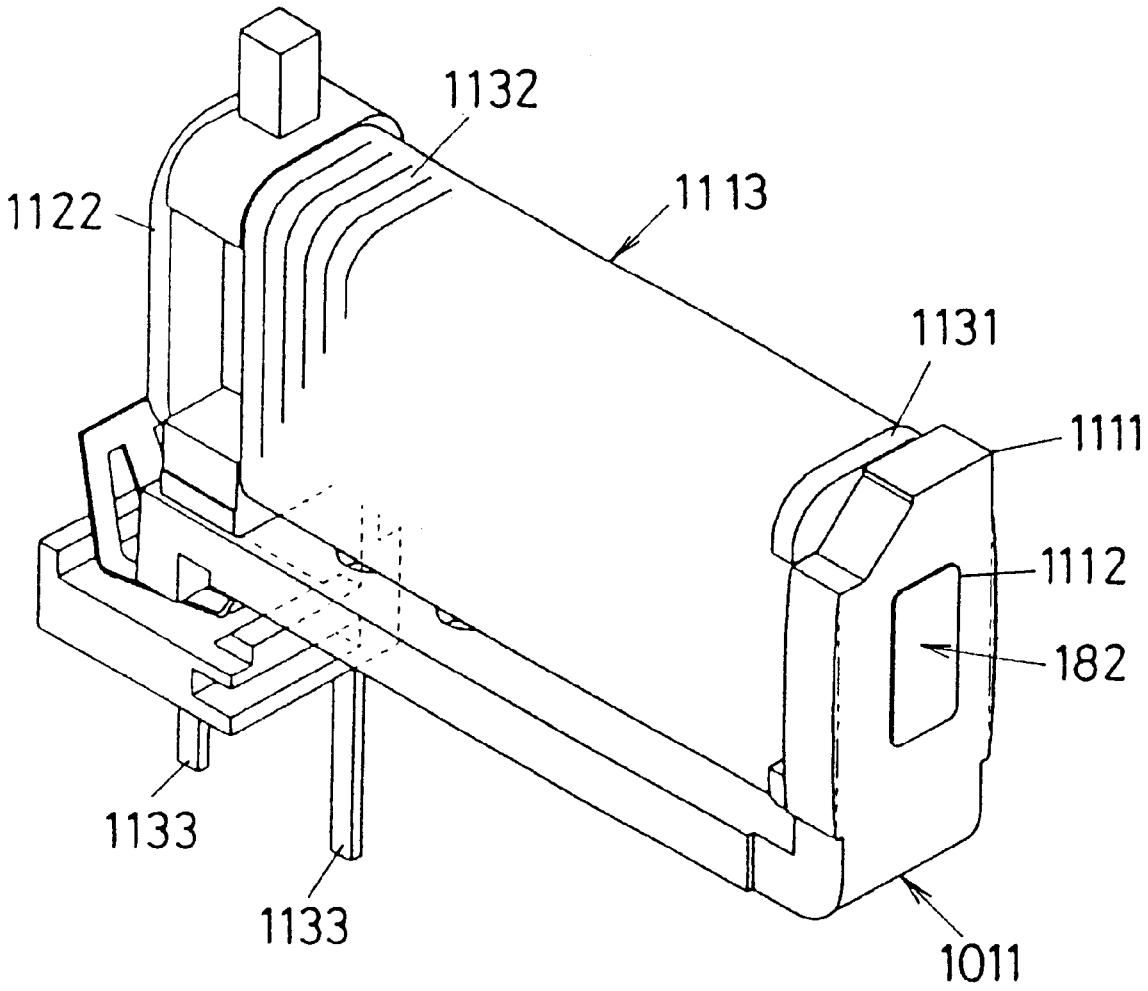
FIG. 1 is a perspective view showing an electromagnet used in a first conventional electromagnetic relay.
Figure 2:
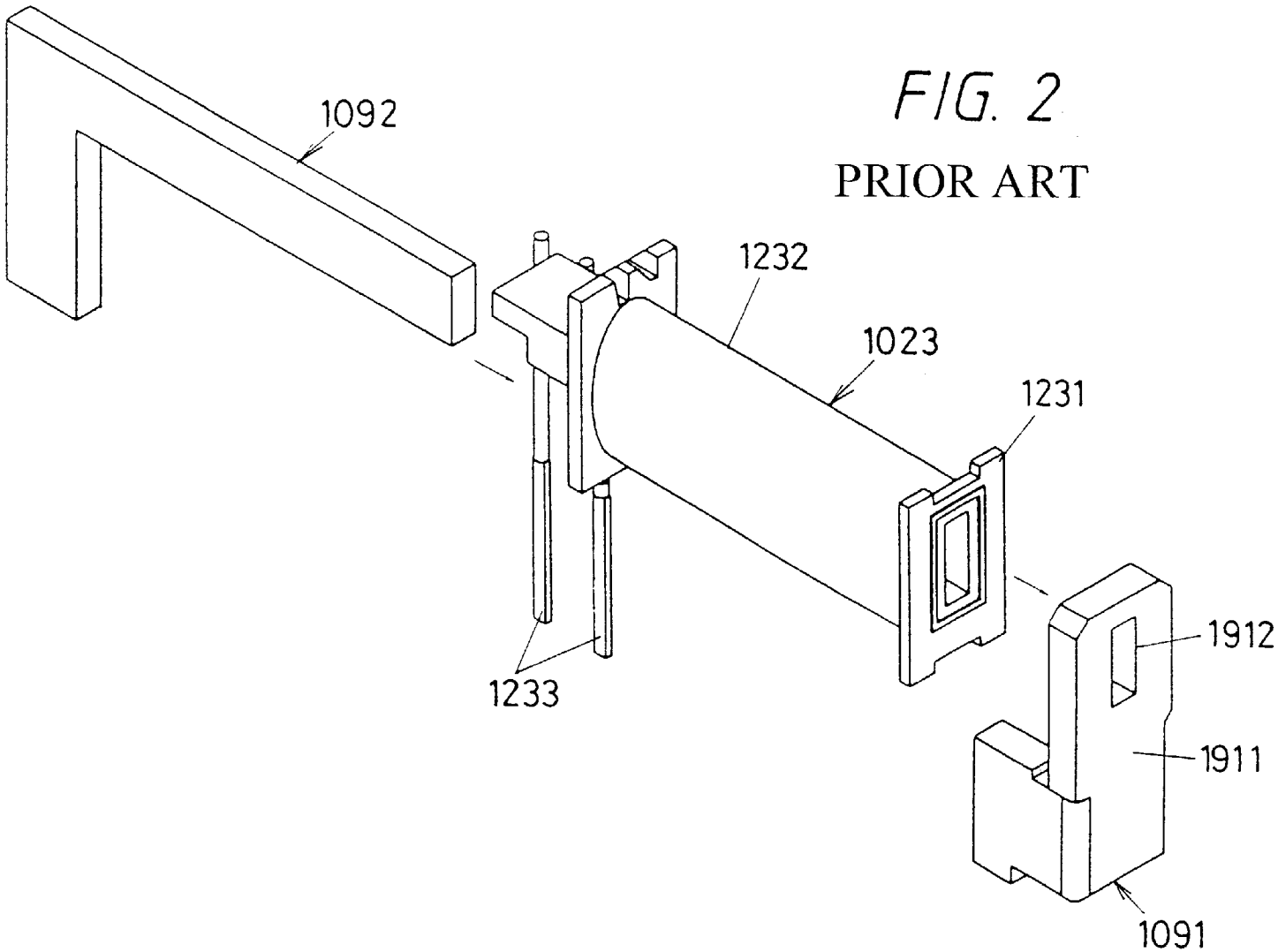
FIG. 2 PRIOR ART
FIG. 2 is an exploded perspective view showing another conventional electromagnet.
Figure 3:
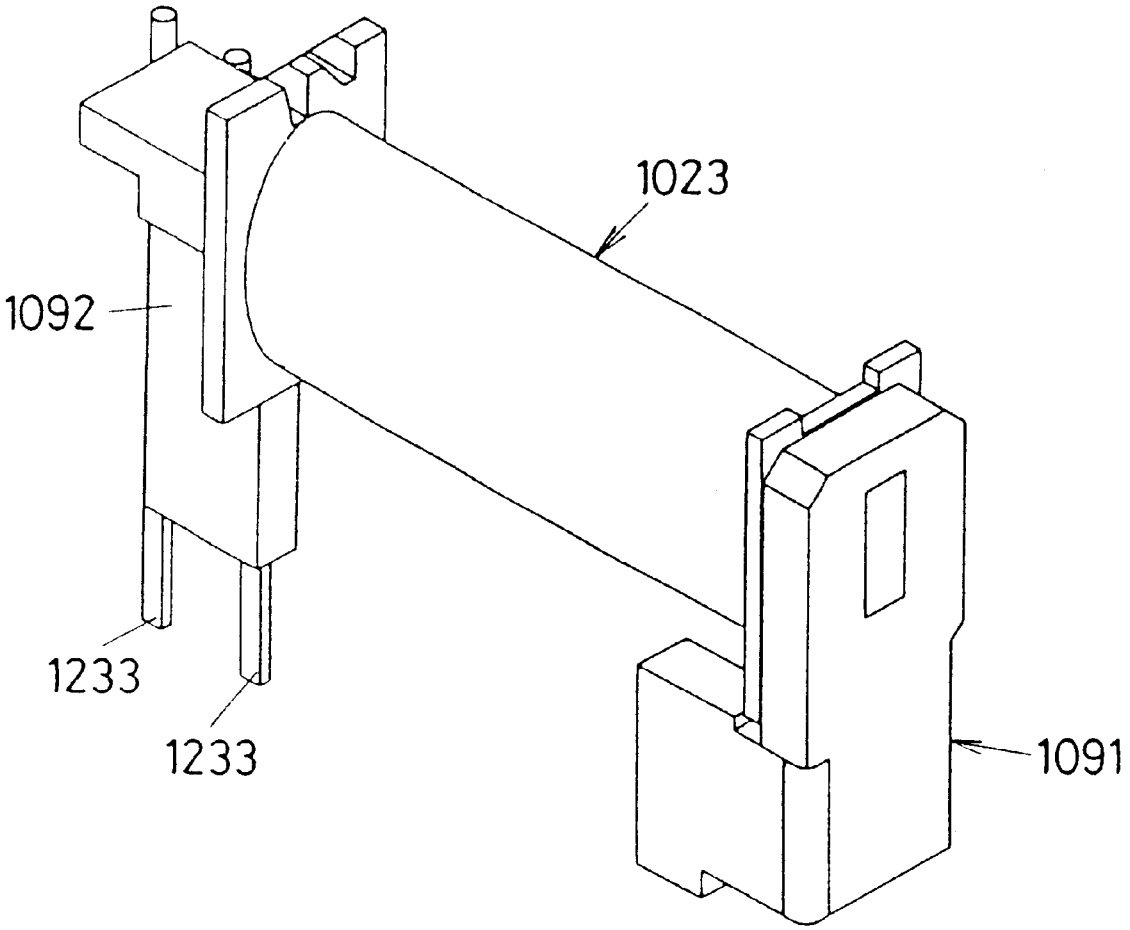
FIG. 3 PRIOR ART
FIG. 3 is a perspective view showing the electromagnet shown in FIG. 2.
Figure 4A:
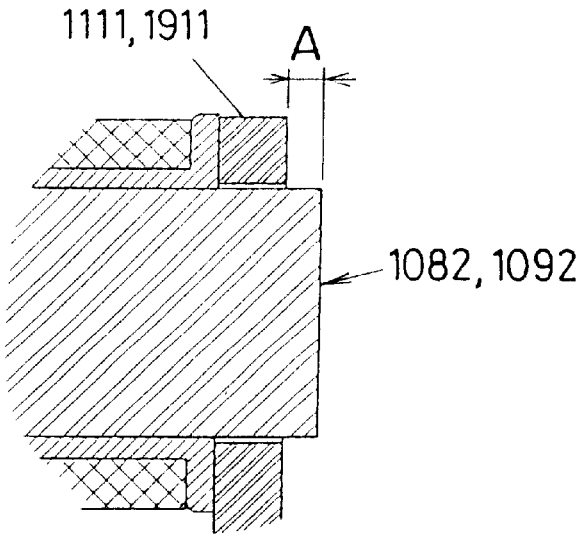
FIG. 4A is a cross sectional view taken on line A—A in FIG. 27A.
Figure 4B:
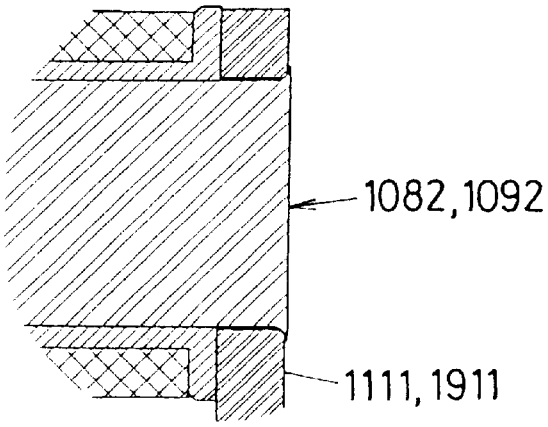
FIGS. 4(*a*), 4(*b*), and 4(*c*) are cross sectional views showing a joining portion of a yoke and an iron core shown in FIG. 1 or 2.
Figure 4C:
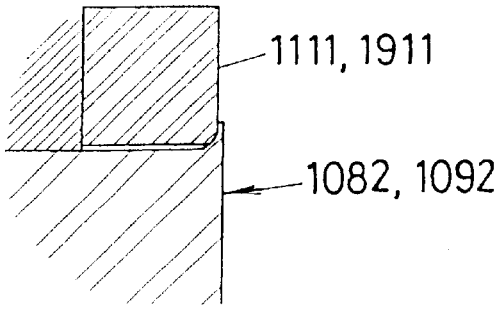
Figure 5:
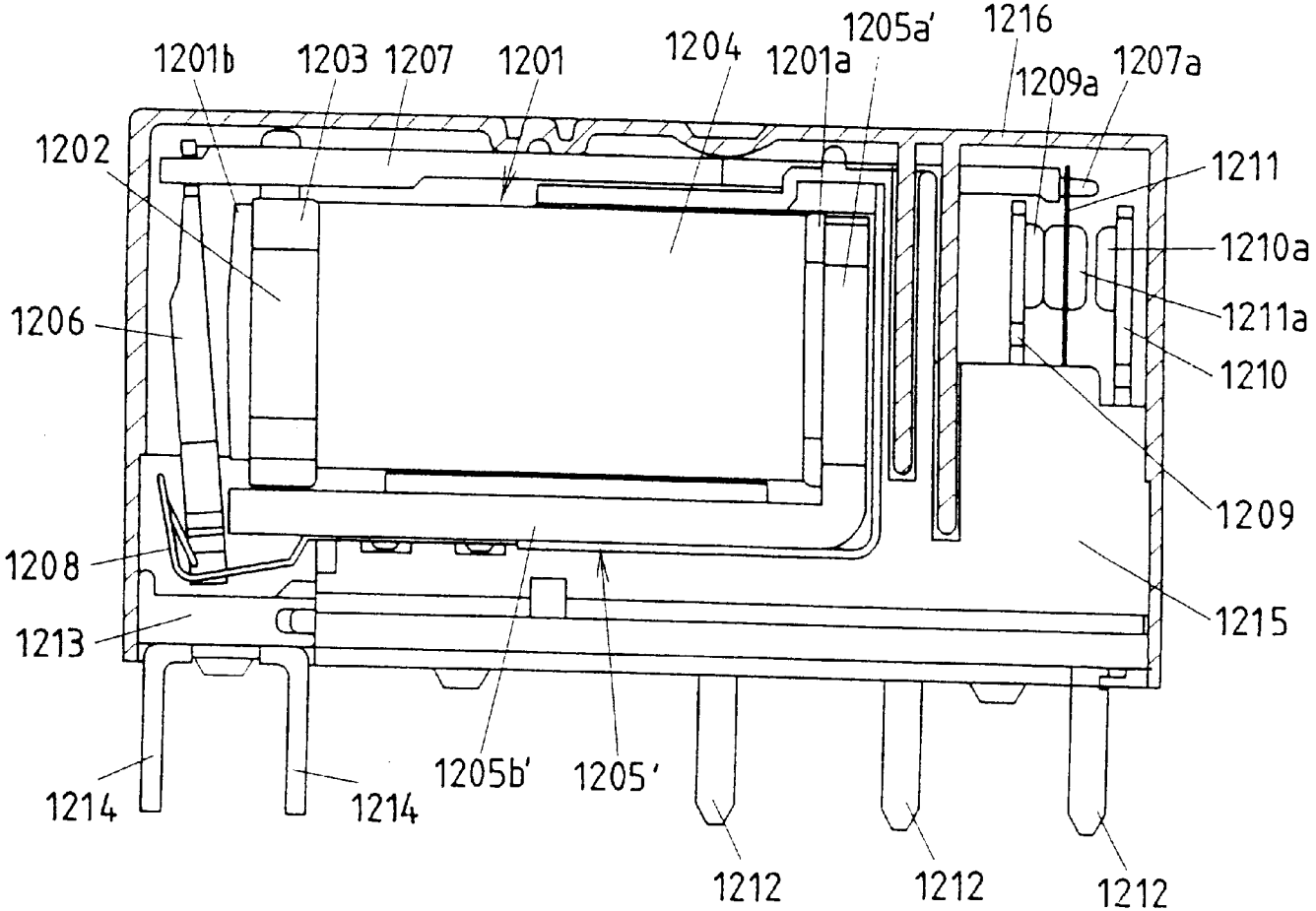
FIG. 5 is a sectional side elevation showing a second conventional electromagnetic relay.
Figure 6B:
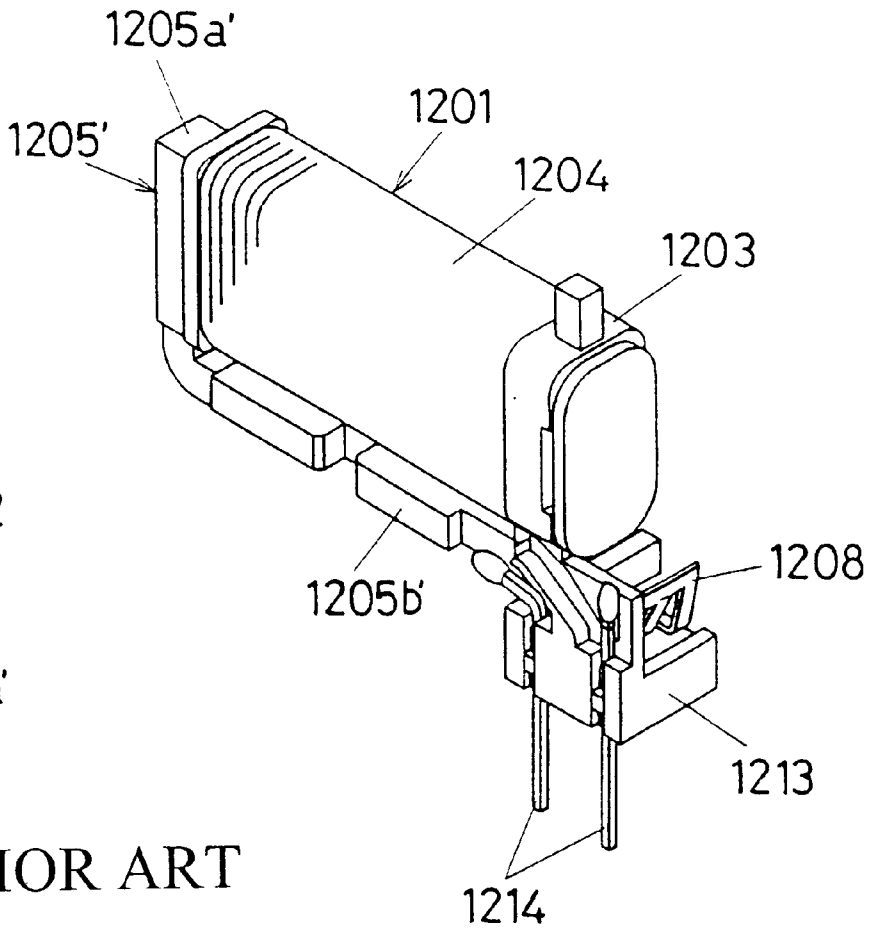
FIGS. 6A and 6B are perspective views showing an electromagnetic block, partly omitted, in the electromagnetic relay when viewed in different directions.
Figure 6A:
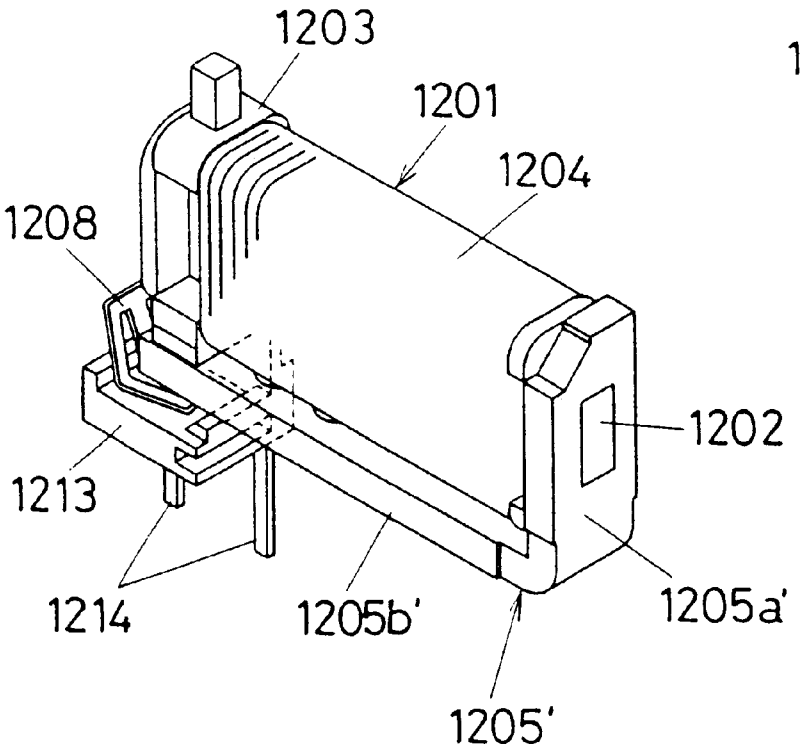
Figure 7:
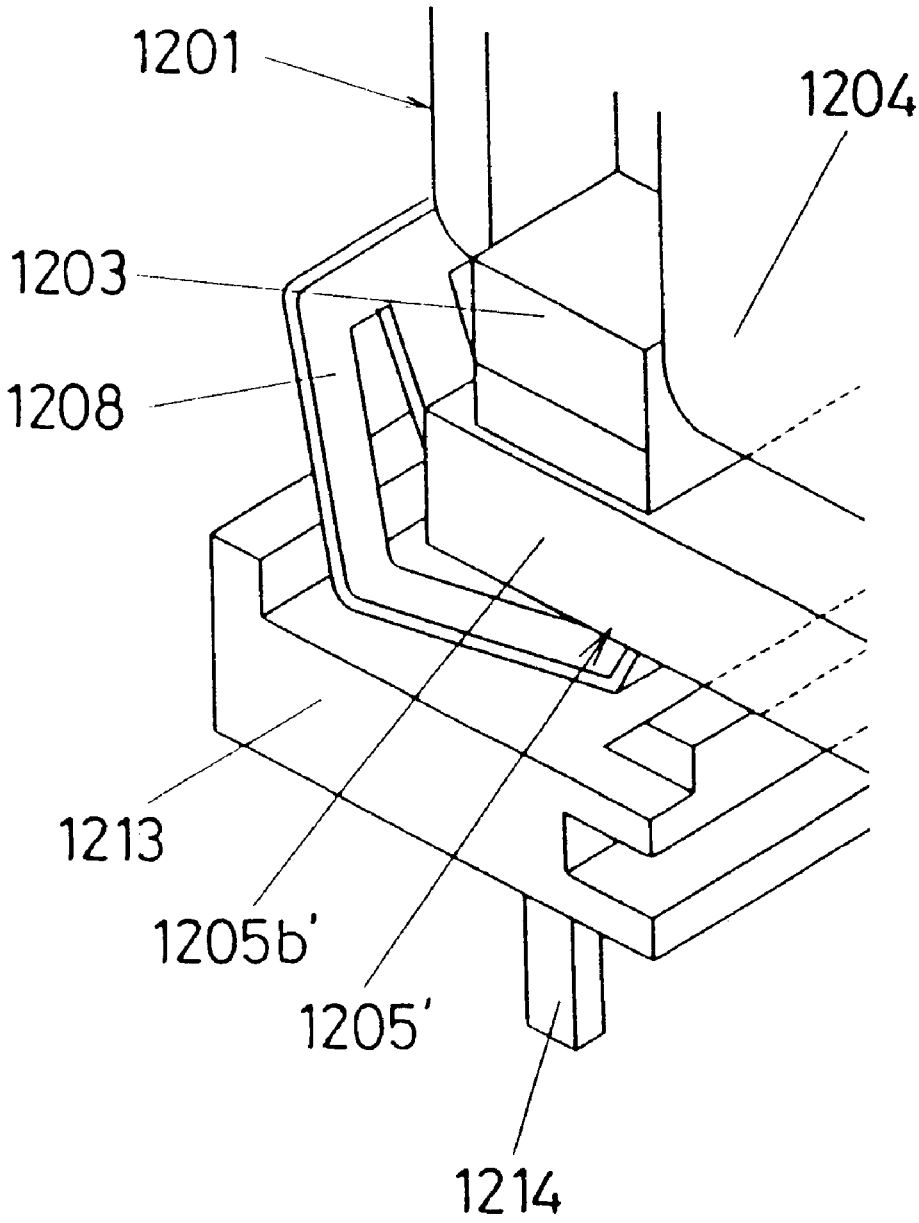
FIG. 7 PRIOR ART
FIG. 7 is a perspective view showing a key portion of the electromagnetic relay, partly omitted.
Figure 8:
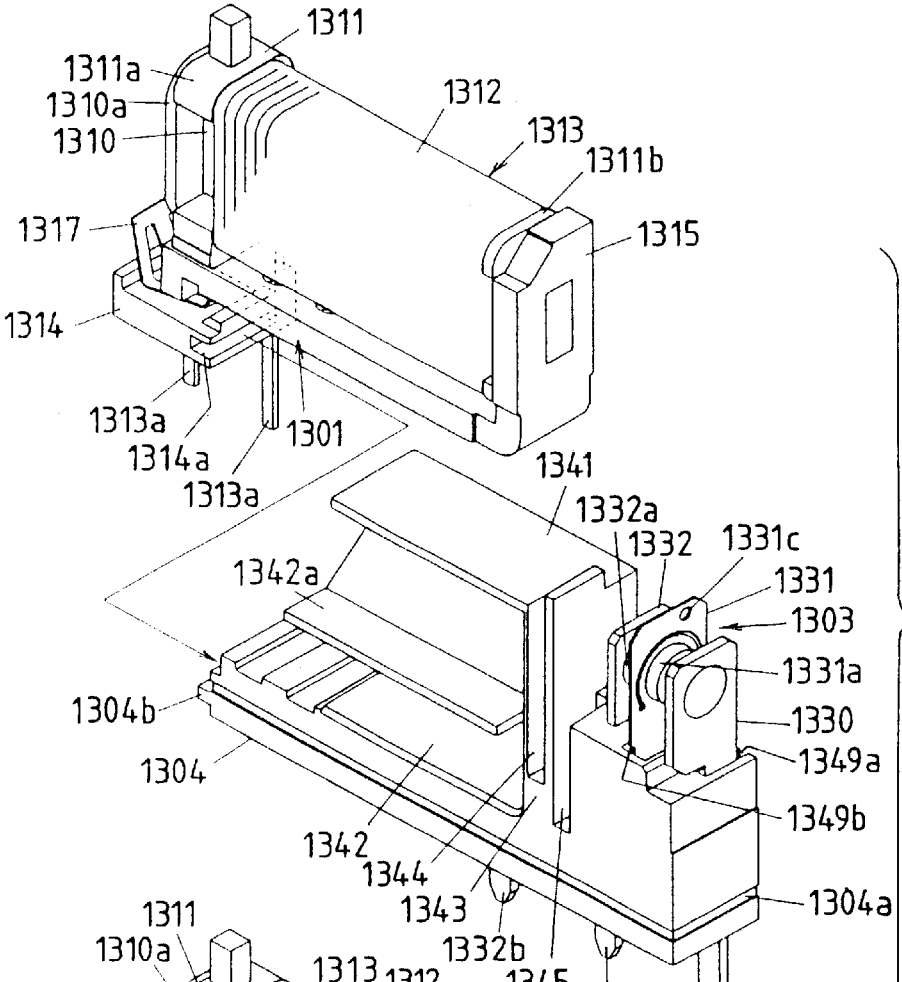
FIGS. 8A and 8B show a third conventional electromagnetic relay.
Figure 8B:
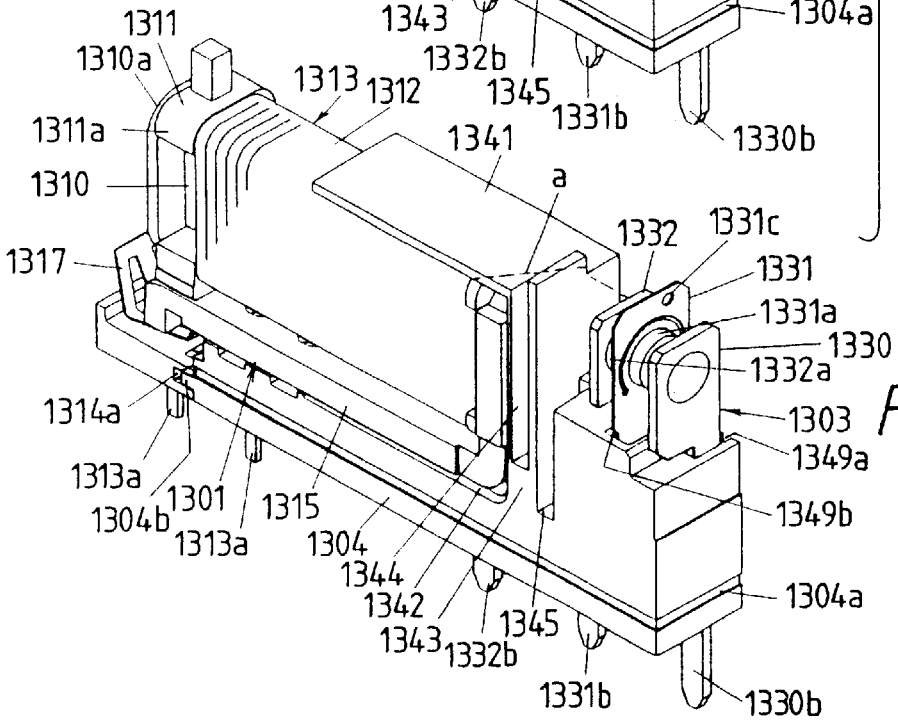
Figure 9B:
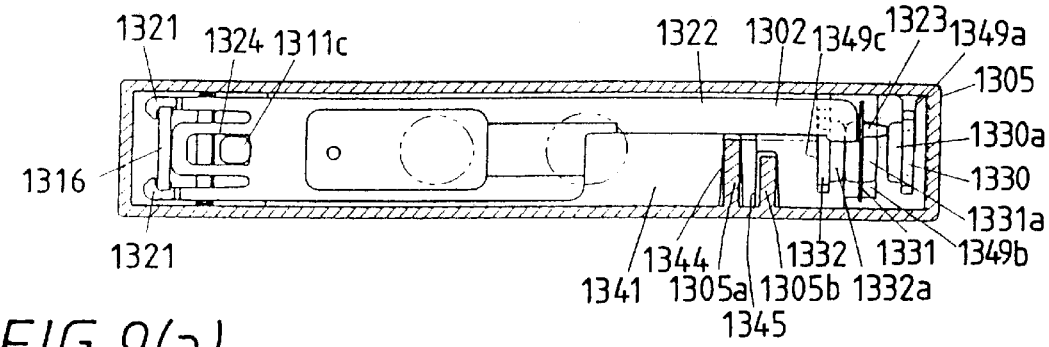
PRIOR ART FIG. 9(b)
FIG. 9B is a cross sectional view when viewed from the top side.
Figure 9A:
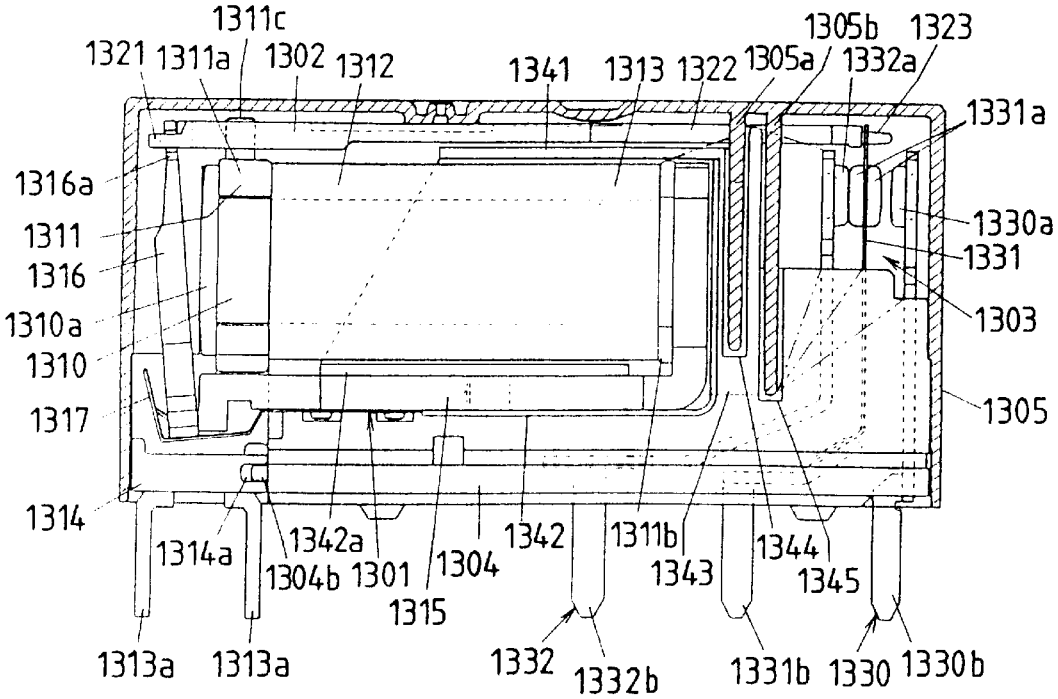
FIGS. 9A and B show the electromagnetic relay.
Figure 10:
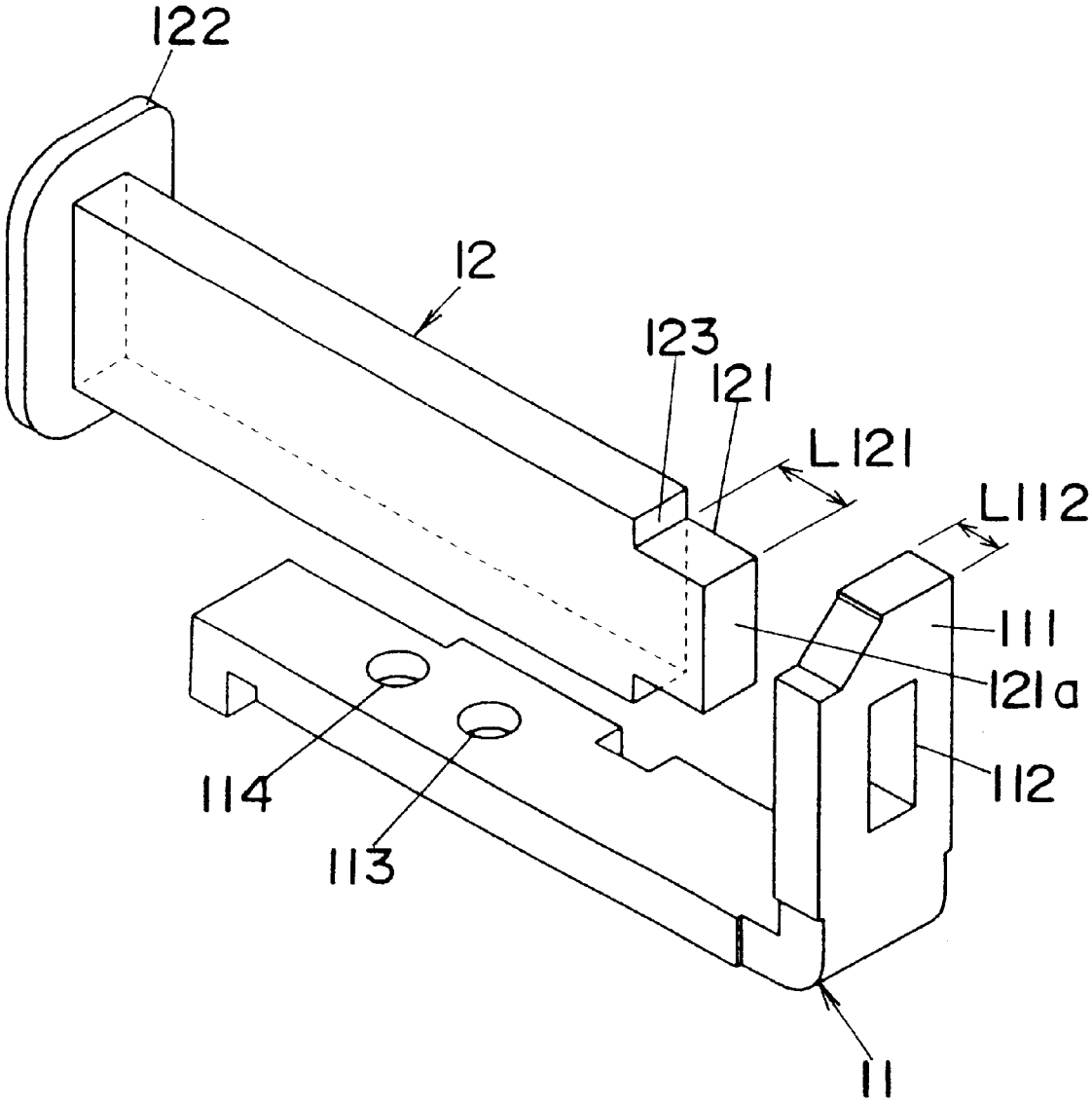
FIG. 10 is a diagram showing a first embodiment according to an electromagnet fixing structure of the present invention.
Figure 11:
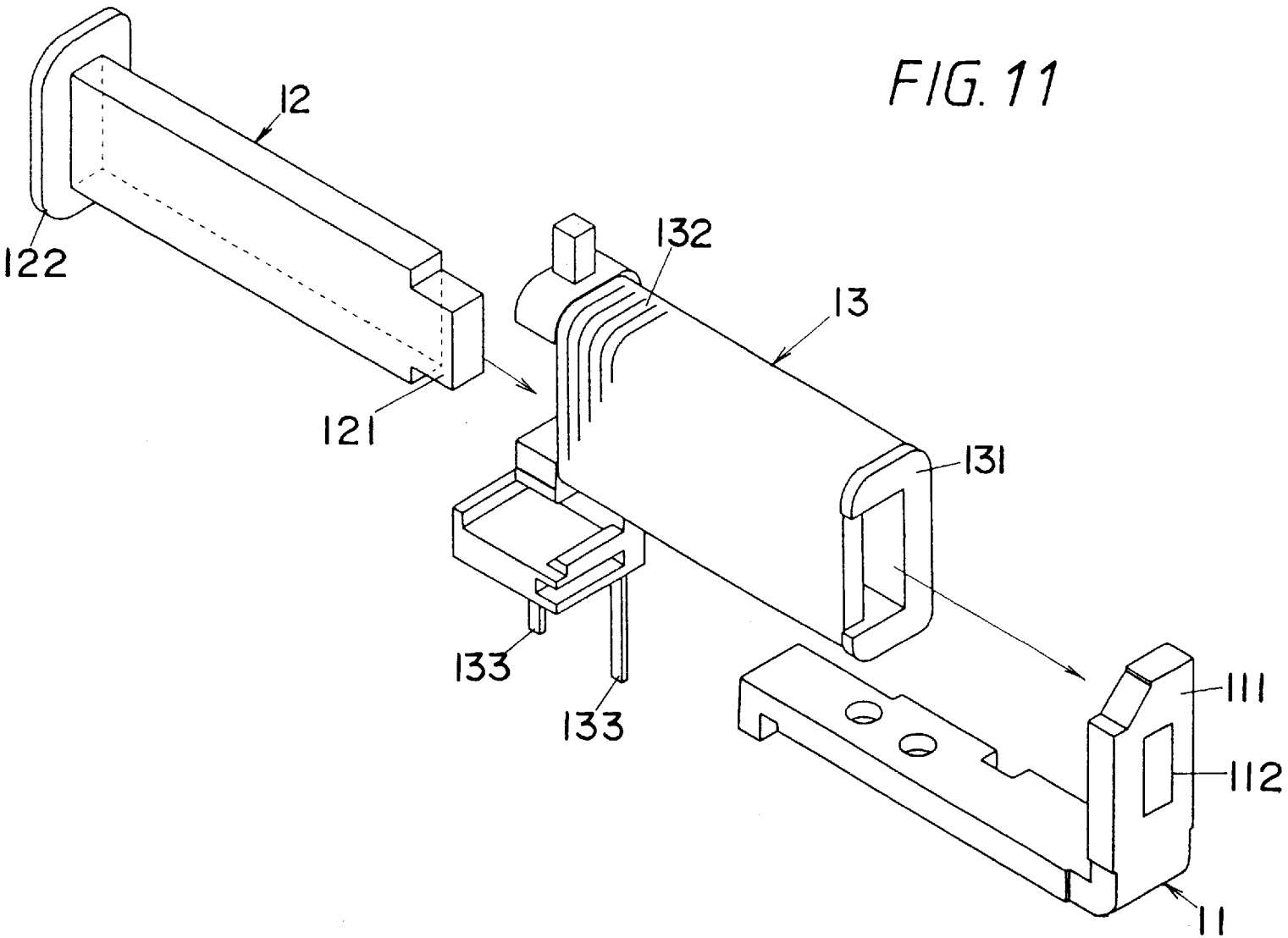
FIG. 11 is an exploded perspective view showing an electromagnet formed with a heel piece and an iron core.
Figure 12:
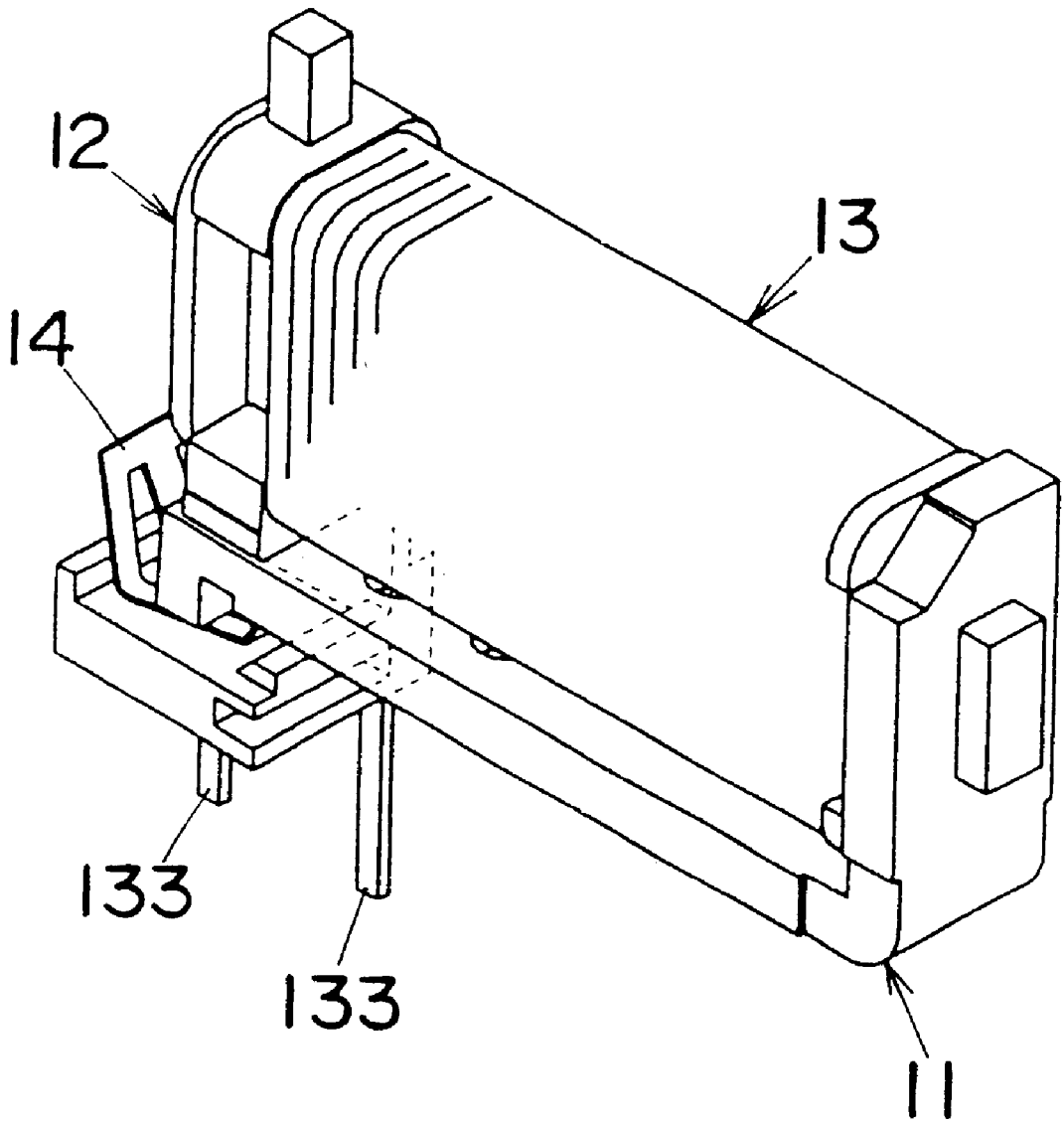
FIG. 12 is a perspective view showing the electromagnet shown in FIG. 3.

FIG. 10 is a diagram showing a first embodiment according to an electromagnet fixing structure of the present invention. FIG. 11 is an exploded perspective view showing an electromagnet formed with a yoke and an iron core. FIG. 12 is a perspective view showing the electromagnet shown in FIG. 11. The first embodiment of the invention will be described with reference to those figures. Also in the description, an embodiment of an electromagnet fixing method for an electromagnetic relay of the invention will also be described. The electromagnet fixing method for the electromagnetic relay of the embodiment may also be applied to embodiments of the invention to subsequently be described.

The electromagnet fixing structure for the electromagnetic relay shown in FIG. 10 concerns a structure for fixing a yoke 11 and an iron core 12, which form an electromagnet. In the fixing structure, a yoke 11, shaped like L, includes a bent surface portion 111. A rectangular through hole 112 is formed in the central portion of the bent surface portion 111. A rod-like iron core 12 is formed which has a cross section larger in the longitudinal direction (vertical direction in FIG. 10) than the rectangular through hole 112. A protruded portion 121 of which the end face 121*a* is somewhat smaller than the through hole 112 is formed at the central portion of one end of the iron core 12. The yoke 11 and the iron core 12 are fixed by inserting the protruded portion 121 into the through hole 112.

Circular holes 113 and 114 are formed in the yoke 11. A flange 122 is formed at the other end of the iron core 12, while being separated from and facing the bent surface portion 111. A length L121 of the protruded portion 121 is selected to be longer than a length L112 of the through hole 112.

The yoke 11 and the iron core 82 in the an electromagnet fixing structure are used together with a coil block 13 which includes a cylindrical bobbin 131 on which a coil 132 is wound and a pair of coil terminals 133 electrically connected to the coil 132, whereby an electromagnet is formed. Here, the yoke 11 and the iron core 12 shown in FIG. 10 are both fixed temporarily.

In the instance of FIG. 12, a fitting 14 is fixed to the iron core 12 by the utilization of the circular holes 113 and 114 of the iron core 12 (see FIG. 13A to be given later).

Figure 13B:
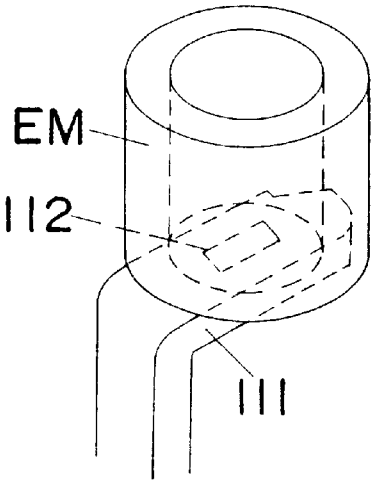
FIGS. 13A and 13B are explanatory diagrams for explaining a electromagnet fixing method for an electromagnetic relay.
Figure 14A:
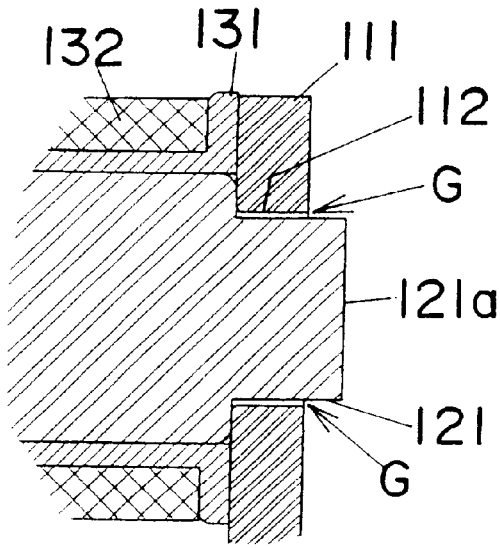
FIGS. 14(*a*), 14(*b*), and 14(*c*) are cross sectional showing how the heel piece and the iron core are fixed before and after those are fixed by the electromagnet fixing method for the electromagnetic relay.
Figure 14B:
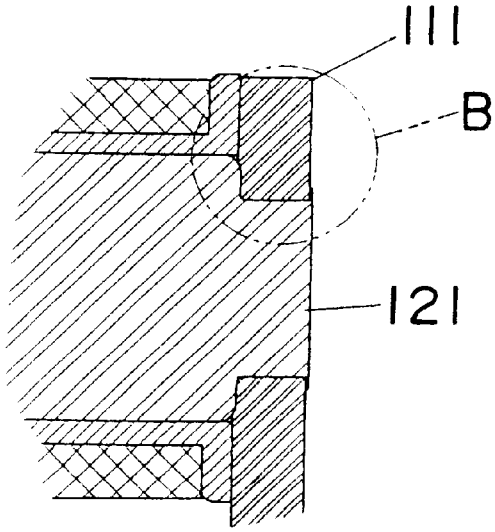
Figure 14C:
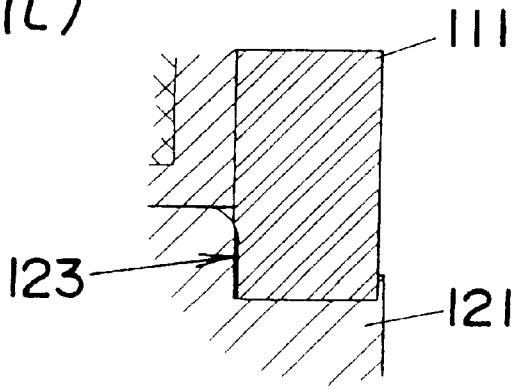
Figure 15:
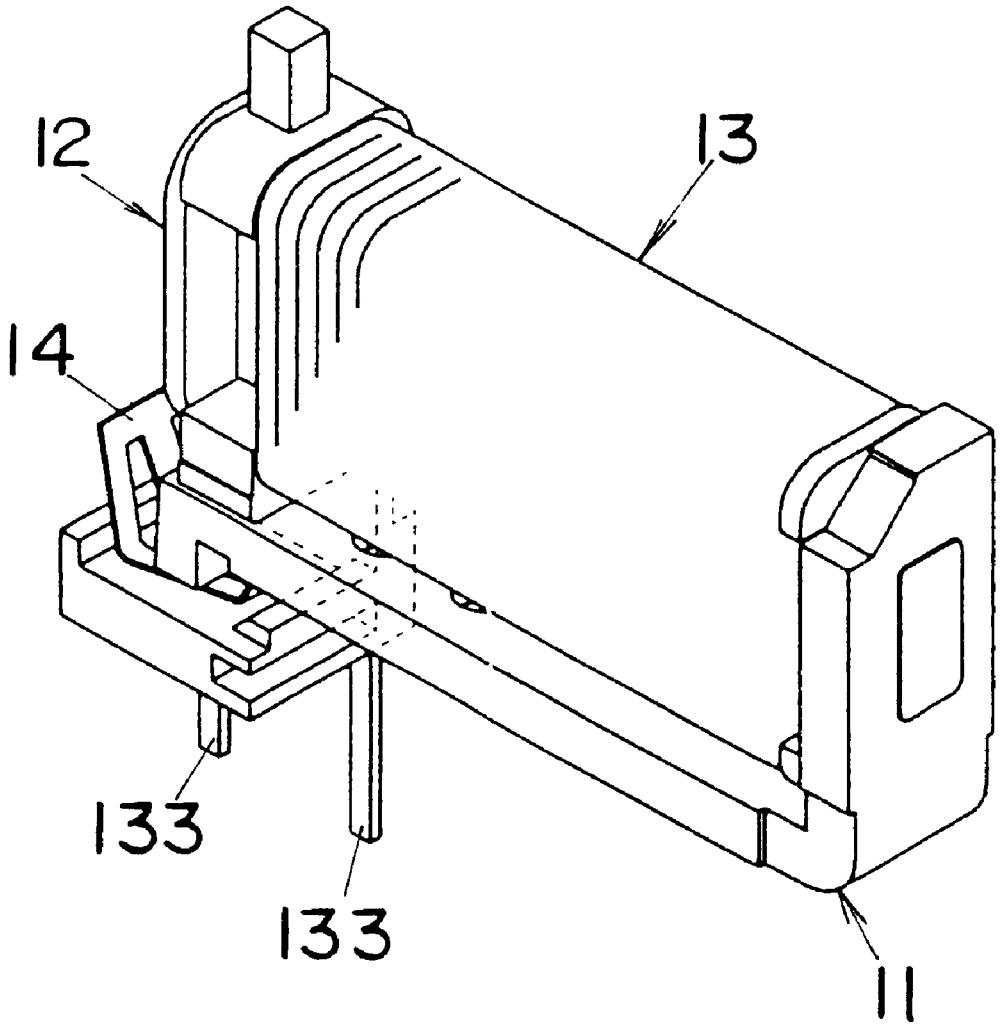
FIG. 15 is a perspective view showing an electromagnet after the heel piece and the iron core are fixed by the electromagnet fixing method for the electromagnetic relay.

FIG. 13 is an explanatory diagram for explaining a electromagnet fixing method for an electromagnetic relay. FIG. 14 is a cross sectional view showing how the yoke and the iron core are fixed before and after those are fixed by the electromagnet fixing method for the electromagnetic relay. FIG. 15 is a perspective view showing an electromagnet after the yoke and the iron core are fixed by the electromagnet fixing method for the electromagnetic relay. The electromagnet fixing method for the electromagnetic relay will be described with reference to those figures. FIG. 14C is an enlarged view showing a portion B in FIG. 14B.

Firstly, the electromagnet shown in FIG. 12 is prepared. At this time, the end face 121*a* of the protruded portion 121 is somewhat smaller than the through hole 112, a gap G is formed as shown in FIG. 14A. Further, since the length L121 of the protruded portion 121 is longer than the length L112 of the through hole 112, the protruded portion 121 is further protruded to the right, from the through hole 112.

Figure 13A:
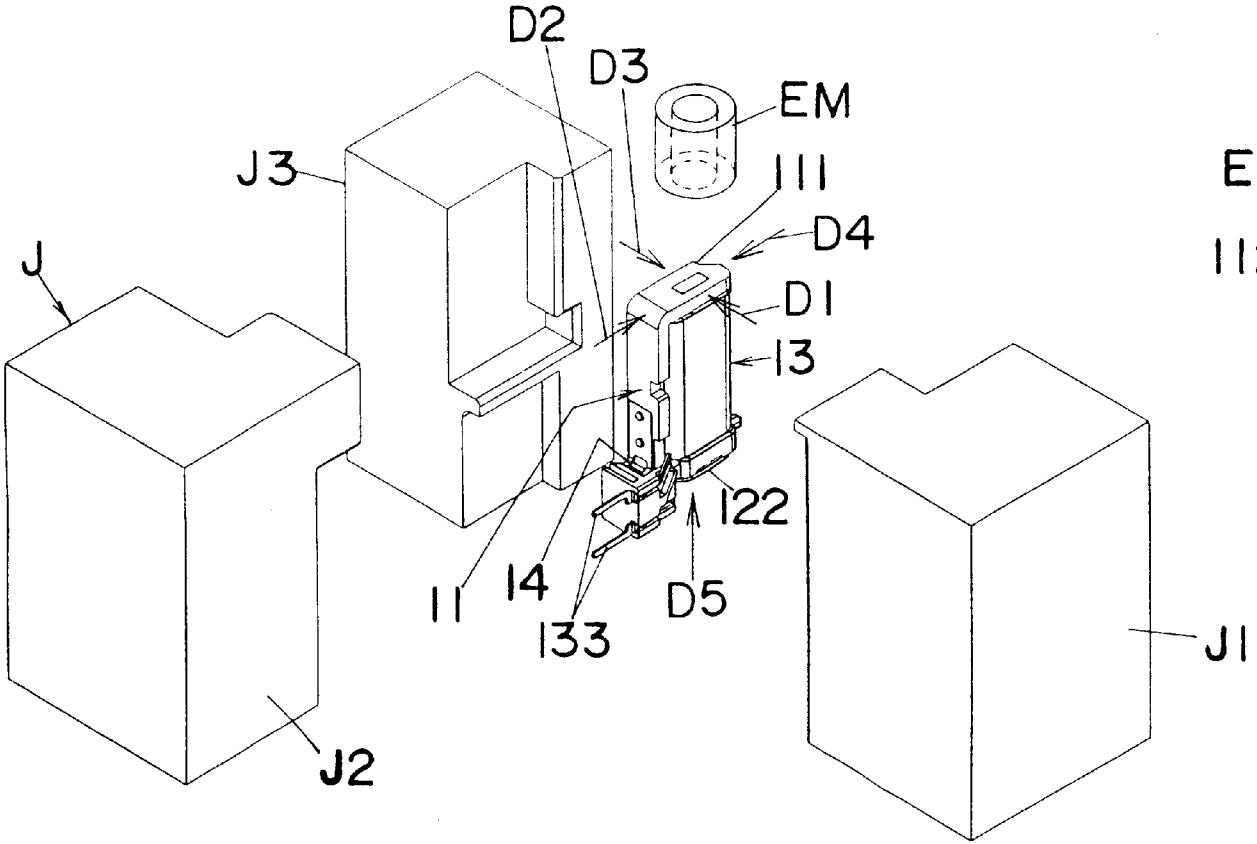

As shown in FIG. 13A, the yoke 11 and the iron core 12, while the protruded portion 121 is inserted into the through hole 112, is fixed, by a press-fitting fixing tool J (fixing tool) consisting of division blocks J1~J3, in a total of five directions, directions D1 to D4 (from the outer peripheral of the bent surface portion 111 to the inner side), and one direction D5 (from the flange 122 to the inner side). The circumference of the through hole 112 in the bent surface portion 111 is pressed downward with a cylindrical elastic member EM made of such a material as urethane rubber (FIG. 13B) . Spin press-fitting is applied through the through hole 112 to a protrusion of the protruded portion 121, i.e., a protrusion of the iron core 12, so as to fill the gap G formed between the through hole 112 and the protruded portion 121 therewith. The press-fitting fixing tool J used in the FIG. 13A instance is designed so as to fix the direction D1 with the division block J1, the direction D2 with the division block J2, and the directions D3 to D5 with the division block J3.

When the spin press-fitting is carried out, as shown in FIG. 14C, the spin press-fitting is applied also to the bent surface portion 111 of the yoke 11 such that the bent surface portion 111 is pressed against the stepped face 123 of the iron core 12 caused by the protruded portion 121, and to such an extent that the iron core 12 is not buckled.

As the result of the spin press-fitting, as shown in FIG. 14B, the protruded portion of the iron core 12 is substantially removed and the gap G is removed. Further, as shown in FIG. 14C, the bent surface portion 111 of the yoke 11 is bit into the stepped face 123 of the iron core 12. As a result, the finally fixed electromagnet shown in FIG. 15 is obtained. the protruded portion with the stepped portions is provided on both upper and lower sides of the iron core, the management of the protruded portions of the iron core is considerably easy and an accuracy on the dimensional variations of the iron-core protruded portions is improved. Therefore, the following problem does not arise. That is, the portions on both sides of the through hole in the bent surface portion are expanded to be deformed when the spin press-fitting is carried out, because of a dimensional variation of the protruded portions of the iron cores. The result is that the magnetic gap is reduced and increase of the attraction force by the electromagnet is possible.

With provision of both the stepped portions, it is possible to prevent the iron core from being tilted at the time of the spin press-fitting. As a result, it is possible to prevent the attraction force of the electromagnet from reducing in magnitude. A stable increase of the attraction force of the electromagnet is realized. Incidentally, the protruded portion may be formed by use of only a trimming machining.

Further, it is possible to prevent a gap from being formed (left) between the yoke and the iron core in a manner that when the spin press-fitting is carried out, the yoke and the iron core are fixed, by means of the press-fitting fixing tool, in the total of five directions, four directions from the outer peripheral of the bent surface portion to the inner side, and one direction from the flange side to the inner side. Therefore, formation (leaving) of a gap between the yoke and the iron core is prevented. Further, a degree of the mechanical coupling of the yoke and the iron core when the spin press-fitting is carried out such that the bent surface portion is pressed against the stepped face of the iron core caused by the protruded portion. As a result, the increase of the attraction force of the electromagnet is possible.

Figure 16:
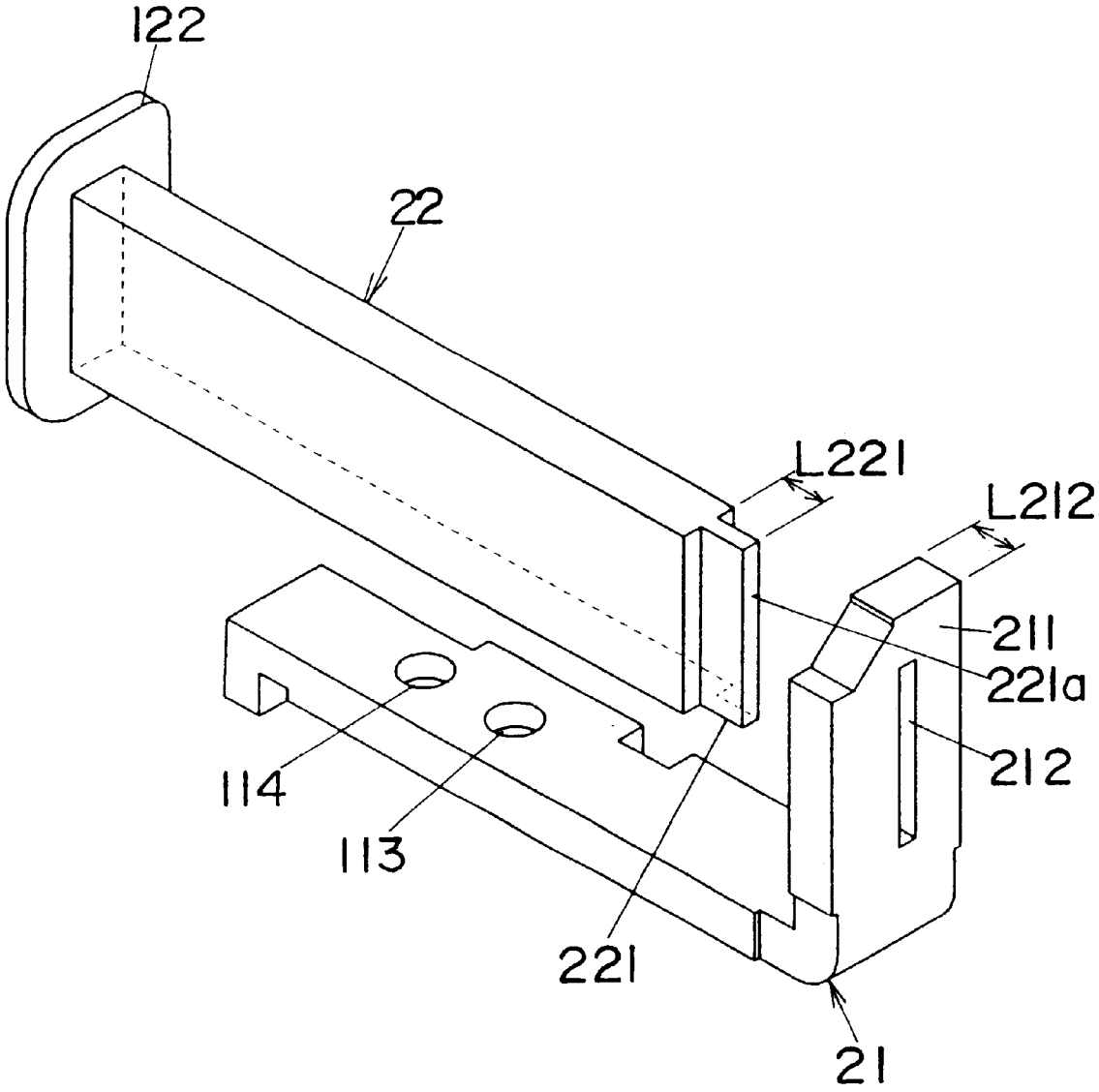
FIG. 16 is a diagram showing a second embodiment according to an electromagnet fixing structure for an electromagnetic relay of the present invention.

FIG. 16 is a diagram showing a second embodiment according to an electromagnet fixing structure for an electromagnetic relay of the present invention. Description of the second embodiment will be given with reference to the figure.

The electromagnet fixing structure for the electromagnetic relay shown in FIG. 16 concerns a structure for fixing a yoke 21 and an iron core 22, which form an electromagnet. In the fixing structure, a yoke 21, shaped like L, includes a bent surface portion 211. A rectangular through hole 212 is formed in the central portion of the bent surface portion 211. A rod-like iron core 12 is formed which has a cross section somewhat shorter in the longitudinal direction (vertical direction in FIG. 16) than the rectangular through hole 112, but somewhat wider than the latter.

A protruded portion 221 of which the end face 221*a* is somewhat smaller than the through hole 212 is formed at the central portion of one end of the iron core. The yoke 21 and the iron core 22 are fixed by inserting the protruded portion 221 into the through hole 212. The yoke 21 and the iron core 22 thus fixed are used together with the coil block 13, and form an electromagnet, as in the first embodiment.

Circular holes 113 and 114 are formed in the yoke 21 as in the first embodiment. Further, flange 122 is formed on the other end of the iron core 22 as in the first embodiment.

In the thus constructed electromagnet fixing structure for an electromagnetic relay, the protruded portion with the stepped portions on both the sides thereof are provided on the iron core. Provision of the stepped portions, it is possible to prevent the iron core from being tilted at the time of the spin press-fitting. As a result, stable increase of the attraction force of the electromagnet is realized. Further, a degree of the magnetic coupling of the yoke and the iron core since a joining area between the yoke and the iron core is increased.

In a case where the a length L221 of the protruded portion 221 is somewhat longer than a length L212 of the through hole 212 before individual component parts are assembled, the management of the protruded portions of the iron core is considerably easy and an accuracy on the dimensional variation of the iron-core protruded portions is improved. Therefore, the following problem does not arise. That is, the portions on both sides of the through hole in the bent surface portion are expanded to be deformed when the spin press-fitting is carried out, because of a dimensional variation of the protruded portions of the iron cores. The result is that the magnetic gap is reduced and increase of the attraction force by the electromagnet is possible.

Figure 17:
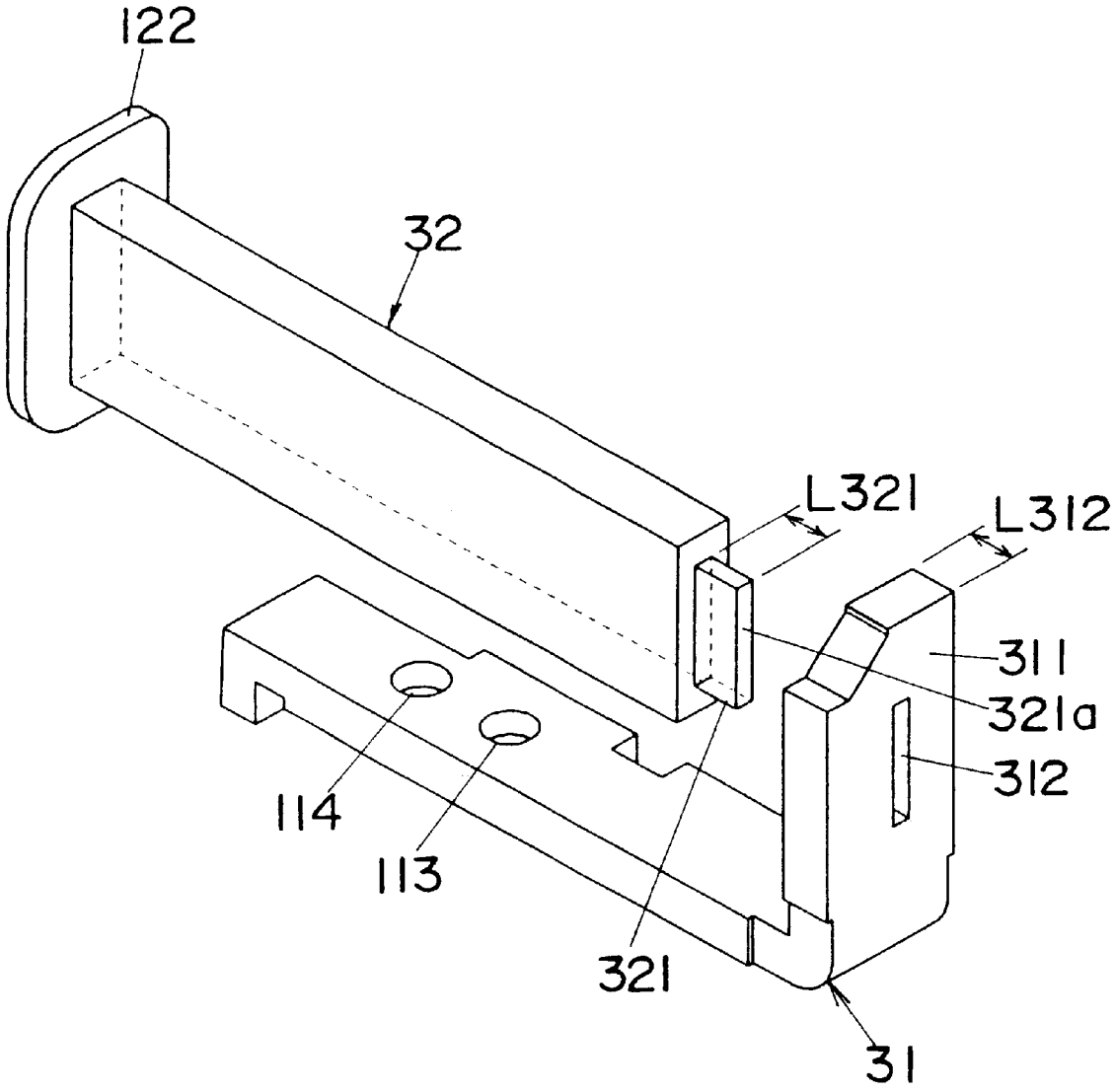
FIG. 17 is a diagram showing a third embodiment according to an electromagnet fixing structure for an electromagnetic relay of the present invention.

FIG. 17 is a diagram showing a third embodiment according to an electromagnet fixing structure for an electromagnetic relay of the present invention. Description of the third embodiment will be given with reference to the figure.

The electromagnet fixing structure for the electromagnetic relay shown in FIG. 17 concerns a structure for fixing a yoke 31 and an iron core 32, which form an electromagnet. In the fixing structure, a yoke 31, shaped like L, includes A rectangular through hole 312 is formed in the central portion of the bent surface portion 311. A rod-like iron core 32 is formed which has a cross section larger than the rectangular through hole 312. A protruded portion 321 of which the end face 321*a* is somewhat smaller than the through hole 312 is formed at the central portion of one end of the iron core 32. The yoke 31 and the iron core 32 are fixed by inserting the protruded portion 321 into the through hole 312. The yoke 31 and the iron core 32 thus fixed are used together with the coil block 13, and form an electromagnet, as in the first embodiment.

Circular holes 113 and 114 are formed in the yoke 31 as in the first embodiment. A flange 122 is formed at the other end of the rod-like iron core 32 as in the first embodiment.

In the thus constructed electromagnet fixing structure for an electromagnetic relay, the protruded portion with the stepped portion therearound is provided on the iron core. Therefore, it is possible to prevent the iron core from being tilted at the time of the spin press-fitting. As a result, it is possible to prevent the attraction force of the electromagnet from being reduced in magnitude, and a stable increase of the attraction force of the electromagnet is realized. Further, a degree of the magnetic coupling of the yoke and the iron core since a joining area between the yoke and the iron core is increased.

In a case where the a length L321 of the protruded portion 321 is somewhat longer than a length L312 of the through hole 312 before individual component parts are assembled, the management of the protruded portions of the iron core is considerably easy and an accuracy on the dimensional variation of the iron-core protruded portions is improved. Therefore, the following problem does not arise. That is, the portions on both sides of the through hole in the bent surface portion are expanded to be deformed when the spin press-fitting is carried out, because of a dimensional variation of the protruded portions of the iron cores. The result is that the magnetic gap is reduced and increase of the attraction force by the electromagnet is possible.

Figure 18:
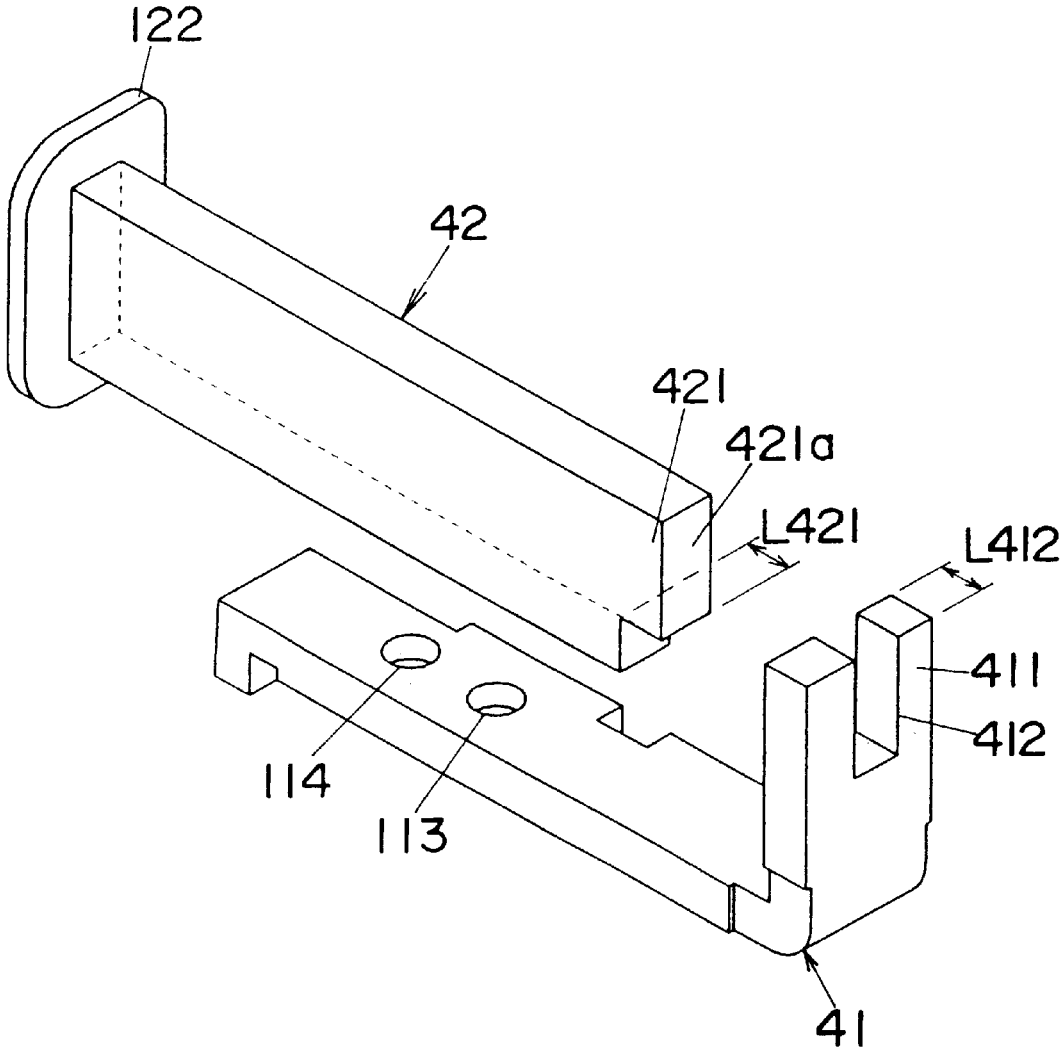
FIG. 18 is a diagram showing a fourth embodiment according to an electromagnet fixing structure for an electromagnetic relay of the present invention.

FIG. 18 is a diagram showing a fourth embodiment according to an electromagnet fixing structure for an electromagnetic relay of the present invention. Description of the fourth embodiment will be given with reference to the figure.

The electromagnet fixing structure for the electromagnetic relay shown in FIG. 18 concerns a structure for fixing a yoke 41 and an iron core 42, which form an electromagnet. In the fixing structure, a yoke 31, shaped like L, includes a bent surface portion 411. A rectangular groove 412 is formed in the upper part of the bent surface portion 411. A rod-like iron core 42 is formed which has a cross section larger than the rectangular groove 412 in the longitudinal direction (vertical direction in FIG. 18). A protruded portion 421 of which the end face 421*a* is somewhat smaller than the rectangular groove 412 is protruded from one end of the iron core 42. The yoke 41 and the iron core 42 are fixed by inserting the protruded portion 421 into the rectangular groove 412. The yoke 41 and the iron core 42 thus fixed are used together with the coil block 13, and form an electromagnet, as in the first embodiment.

Circular holes 113 and 114 are formed in the yoke 41 as in the first embodiment. A flange 122 is formed at the other end of the iron core 42 as in the first embodiment.

Figure 19A:
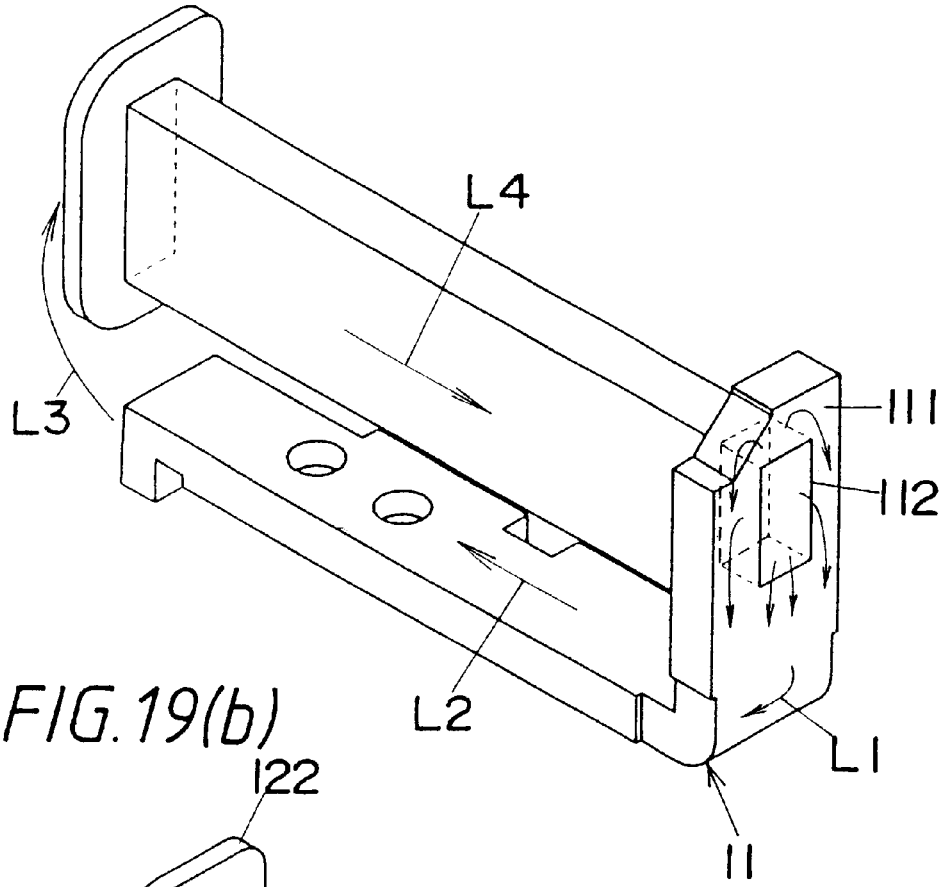
FIGS. 19A and 19B are explanatory diagrams for explaining the reason why the rectangular groove is formed in the bent surface portion of the heel piece.

FIG. 19 is an explanatory diagram for explaining the reason why the rectangular groove 412, not the through hole, is formed in the bent surface portion 411 of the yoke 41. In the an electromagnet fixing structure shown in FIG. 15, in a main magnetic path indicated by arrows L1 to L4, the magnetic loss is maximized at the portion of the through hole 112 of the bent surface portion 111 of the yoke 11. This is as already described.

Figure 19B:
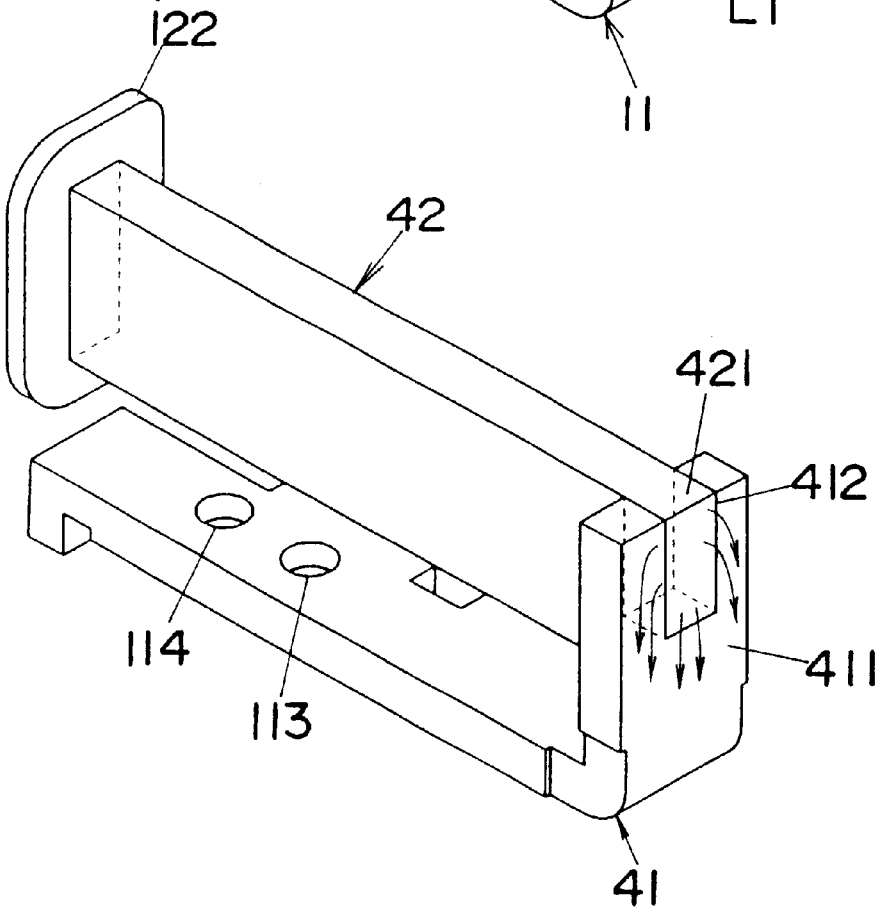

To cope with this, in the fourth embodiment, as shown in FIG. 19B, the rectangular groove 412 is formed in the bent surface portion 411. With provision of this, the rectangular groove 412 of the bent surface portion 411 of the yoke 11 and the protruded portion 421 of the iron core 42 are joined by three surfaces, the right and left sides and the lower side, whereby the upper surface of the protruded portion 421 is separated from the magnetic loss area.

With such a structure, a magnetic loss occurring between the rectangular groove 412 of the bent surface portion 411 and the protruded portion 421 of the iron core 42 is reduced, resulting in increase of the attraction force of the electromagnet.

In a case where the a length L421 of the protruded portion 421 is somewhat longer than a length L412 of the rectangular groove 412 before individual component parts are assembled, the management of the protruded portions of the iron core is considerably easy and an accuracy on the dimensional variation of the iron-core protruded portions is improved. Therefore, the following problem does not arise. That is, the portions on both sides of the through hole in the bent surface portion are expanded to be deformed when the spin press-fitting is carried out, because of a dimensional variation of the protruded portions of the iron cores. The result is that the magnetic gap is reduced and increase of the attraction force by the electromagnet is possible.

Figure 20:
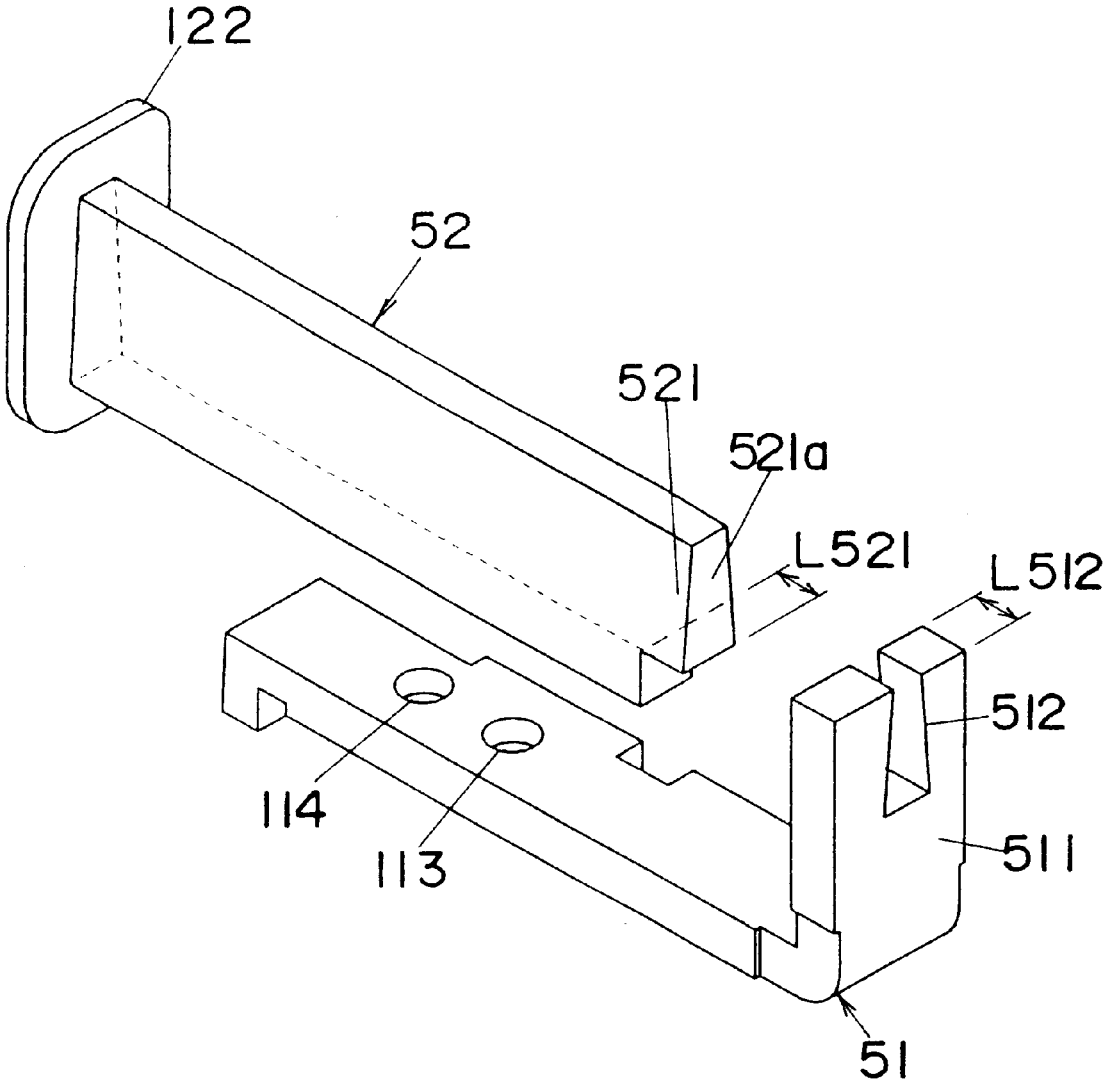
FIG. 20 is a diagram showing a fifth embodiment according to an electromagnet fixing structure for an electromagnetic relay of the present invention.
Figure 21:
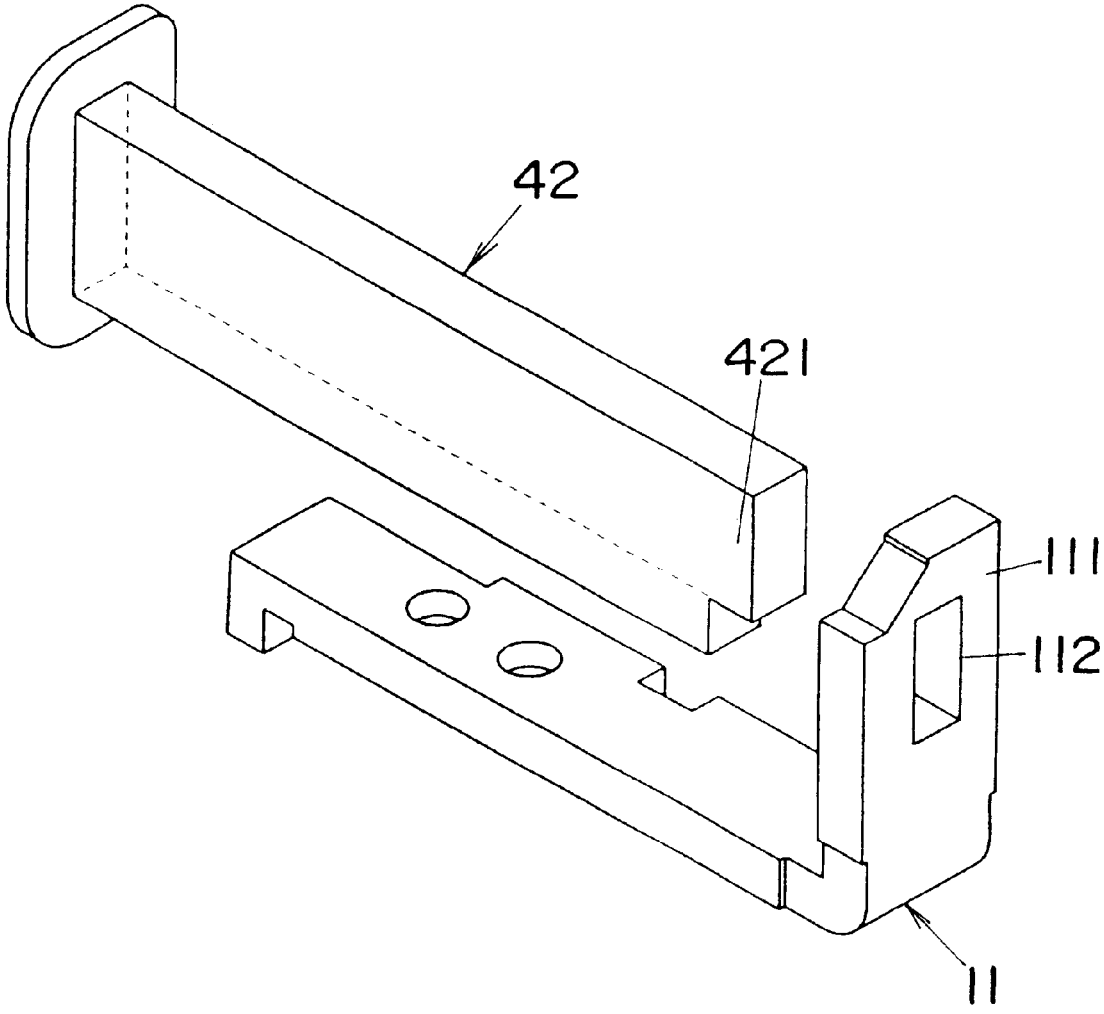
FIG. 21 is a diagram showing a sixth embodiment of an electromagnet fixing structure which provides an easy management of the protruded portions of the iron cores.

FIG. 20 is a diagram showing a fifth embodiment according to an electromagnet fixing structure for an electromagnetic relay of the present invention. Description of the third embodiment will be given with reference to the figure.

The electromagnet fixing structure for the electromagnetic relay shown in FIG. 20 concerns a structure for fixing a yoke 51 and an iron core 52, which form an electromagnet. In the fixing structure, a yoke 51, shaped like L, includes a bent surface portion 511. A trapezoidal groove 512 is formed in the upper part of the bent surface portion 511. The trapezoidal groove 512 is configured such that the width of the groove increases with increase of its depth. A rod-like iron core 52 is formed which has a cross section extending further downward from the bottom of the trapezoidal groove 512, in addition to the size of the trapezoidal groove 512. protruded portion 521 of which the end face 521*a* is somewhat smaller than the trapezoidal groove 512 is protruded from one end of the iron core 52. The yoke 51 and the iron core 52 are fixed by inserting the protruded portion 521 into the trapezoidal groove 512. The yoke 51 and the iron core 52 thus fixed are used together with the coil block 13, and form an electromagnet, as in the first embodiment.

Circular holes 113 and 114 are formed in the yoke 51 as in the first embodiment. A flange 122 is formed at the other end of the iron core 52 as in the first embodiment.

In the an electromagnet fixing structure for an electromagnet, the trapezoidal groove 512, not the through hole, is formed in the bent surface portion 511 of the yoke 51. With such a structure, a magnetic loss occurring between the trapezoidal groove 512 of the bent surface portion 511 and the protruded portion 521 of the iron core 52 is reduced, resulting in increase of the attraction force of the electromagnet.

When the yoke 51 and the iron core 52 are finally fixed by the spin press-fitting, there is no chance that the protruded portion 521 of the iron core 52 slips of f from the trapezoidal groove 512 of the yoke 51 since the trapezoidal groove 512 is trapezoidal in shape.

In a case where the a length L521 of the protruded portion 521 is somewhat longer than a length L512 of the trapezoidal groove 512 before individual component parts are assembled, the management of the protruded portions of the iron core is considerably easy and an accuracy on the dimensional variation of the iron-core protruded portions is improved. Therefore, the following problem does not arise. That is, the portions on both sides of the through hole in the bent surface portion are expanded to be deformed when the spin press-fitting is carried out, because of a dimensional variation of the protruded portions of the iron cores. The result is that the magnetic gap is reduced and increase of the attraction force by the electromagnet is possible.

FIG. 20 is a diagram showing a sixth embodiment according to an electromagnet fixing structure for an electromagnetic relay of the present invention.

In this electromagnet fixing structure, a yoke 11, shaped like L, includes a bent surface portion 111. A rectangular through hole 112 is formed in the bent surface portion 111. A rod-like iron core 42 is formed which has a cross section longer in the longitudinal direction than the rectangular through hole 112. A protruded portion 421 of which the end face is somewhat smaller than the through hole 112 is protruded from the upper part of one end of the iron core 42. The yoke 11 and the iron core 42 are fixed by inserting the protruded portion 421 into the through hole 112.

Enlarge Contact Area Increase Portion

Figure 23B:
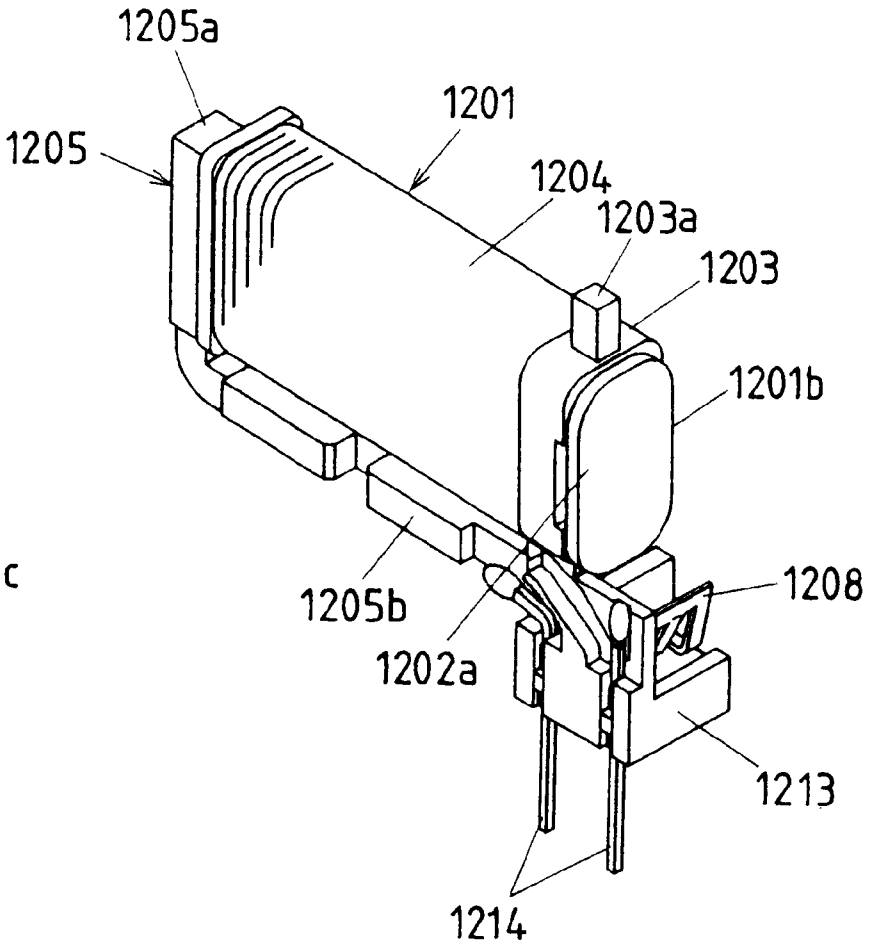
FIGS. 23A and 23B are perspective views showing an electromagnetic block, partly omitted, in the embodiment when viewed in different directions.
Figure 23A:
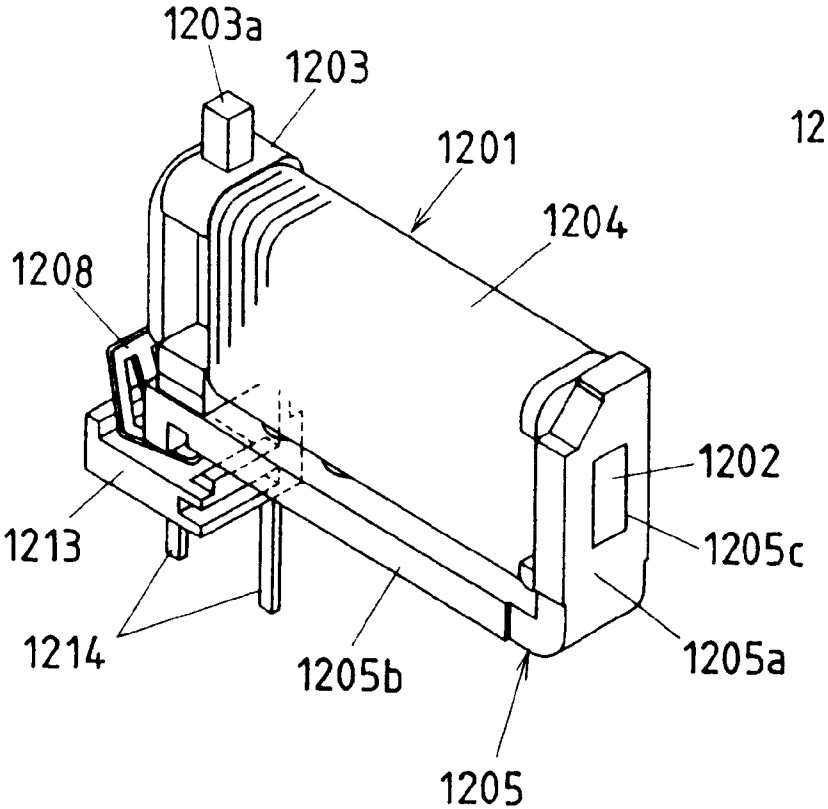
Figure 24:
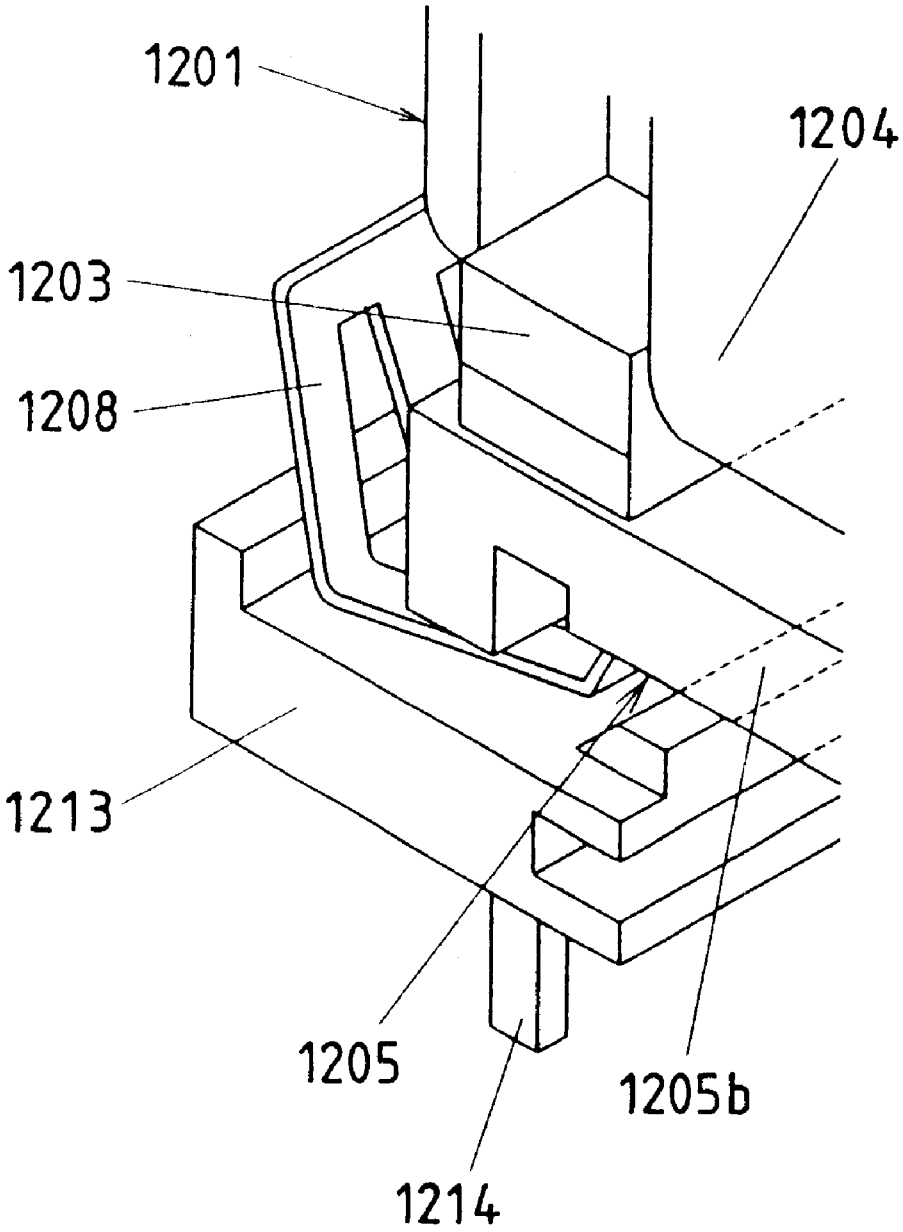
FIG. 24 is a perspective view showing a key portion of the embodiment, partly omitted.

The preferred embodiment of the present invention will be described with reference to FIGS. 22 through 24. A basic construction of this embodiment is substantially the same as of the second conventional electromagnetic relay. Therefore, like reference numerals are used for designating like or equivalent portions in the description of the conventional electromagnetic relay.

A coil bobbin 1203 of an electromagnetic block is formed integral with a terminal support 1213 for supporting a terminals 1214. The material of those is synthetic resin. A plate-like iron core 1202 is inserted into the central portion of the coil bobbin 1203 in the axial direction. One end of the iron core 1202, which will be used as a first magnetic pole 1201*a* , is inserted into a fitting hole 1205*c* formed in an upright portion 1205*a* of the yoke 1205, and then press-fitted. As a result, the yoke 1205 and the iron core 1202 are electrically and mechanically coupled to each other.

A collar 1202*a*, which will be used as a second magnetic pole 1201*b* is formed at the other end of the iron core 1202. An armature 1206, while facing the collar 1202*a*, is disposed in a state that it rotates about the end of the lateral portion 1205*b* of the yoke 1205.

The lower end of the armature 1206 is fastened to the other end of the hinge spring 1208, which is fastened at one end to the lateral portion 1205*b* of the yoke 1205. The armature 1206 is rotatably supported by the hinge spring 1208 at a position apart from the second magnetic pole 1201*b* of the electromagnet 1201. An electromagnetic block is assembled into a concavity portion 1215*b*, which is enclosed with a holder wall 1215*a* and the base 1215. The holder wall 1215*a*, shaped like L in cross section, stands upright on the side edge of the other end of the upper surface of the base 1215 made of synthetic resin. The fixed contact plates 1209 and 1210, which are integral with the external terminals 1212, and the movable contact plate 1211 are located at the other end of the base 1215. The fixed contact plates 1209 and 1210 and the movable contact plate 1211 are arrayed in line while the movable contacts 1211*a* faces the fixed contacts 1209*a* and 1210*a*. An insulating wall 1215*c* is erected at the ends of the fixed contact plates 1209 and 1210 and the movable contact plate 1211, while isolating the fixed contact plates 1209 and 1210 from the movable contact plate 1211.

One end of the card 1207 is brought into engagement with the upper end of the armature 1206. The card 1207 is shaped like a plate, is made of insulating synthetic resin. One end of it, as described above, is brought into engagement with the upper end of the armature 1206. A conical protrusion 1207*a*, which is protruded from the other end of the card 1207, is inserted into a hole (not shown) bored in the upper end of the movable contact plate 1211. A rib 1203*a* is projected from the upper face of the end of the coil bobbin 1203 is movably inserted into a hole (not shown) located near a portion of the card 1207 where it engages the armature 1206, whereby the card 1207 is positioned. The card 1207, together with the electromagnetic block, is assembled into the concavity portion 1215*b* of the base 1215, while being bridged between the armature 1206 and the movable contact plate 1211. One end portion of the card 1207 is reduced in width so as to avoid the insulating wall 1215*c*.

The armature 1206 is urged by the hinge spring 1208 in a direction in which it moves apart from the second magnetic pole 1201*b* of the electromagnet 1201. In the stationary state where no voltage is applied to between the terminals 1214, an attraction force by the movable contact plate 1211 is absent. Accordingly, the armature 1206 is held at the stationary position separated from the second magnetic pole 1201*b*. In the stationary position, the protrusion 1203*a* of the coil bobbin 1203 serves as a stopper. When the armature 1206 is at the stationary position, the card 1207 has been moved to the left in FIG. 22B. In this state, the movable contact plate 1211 is not pushed with the end of the card 1207. The movable contacts 1211*a* is held in the stationary state where the movable contacts 1211*a* is in contact with the fixed contact 1209*a* on the normally closed side.

Figure 22B:
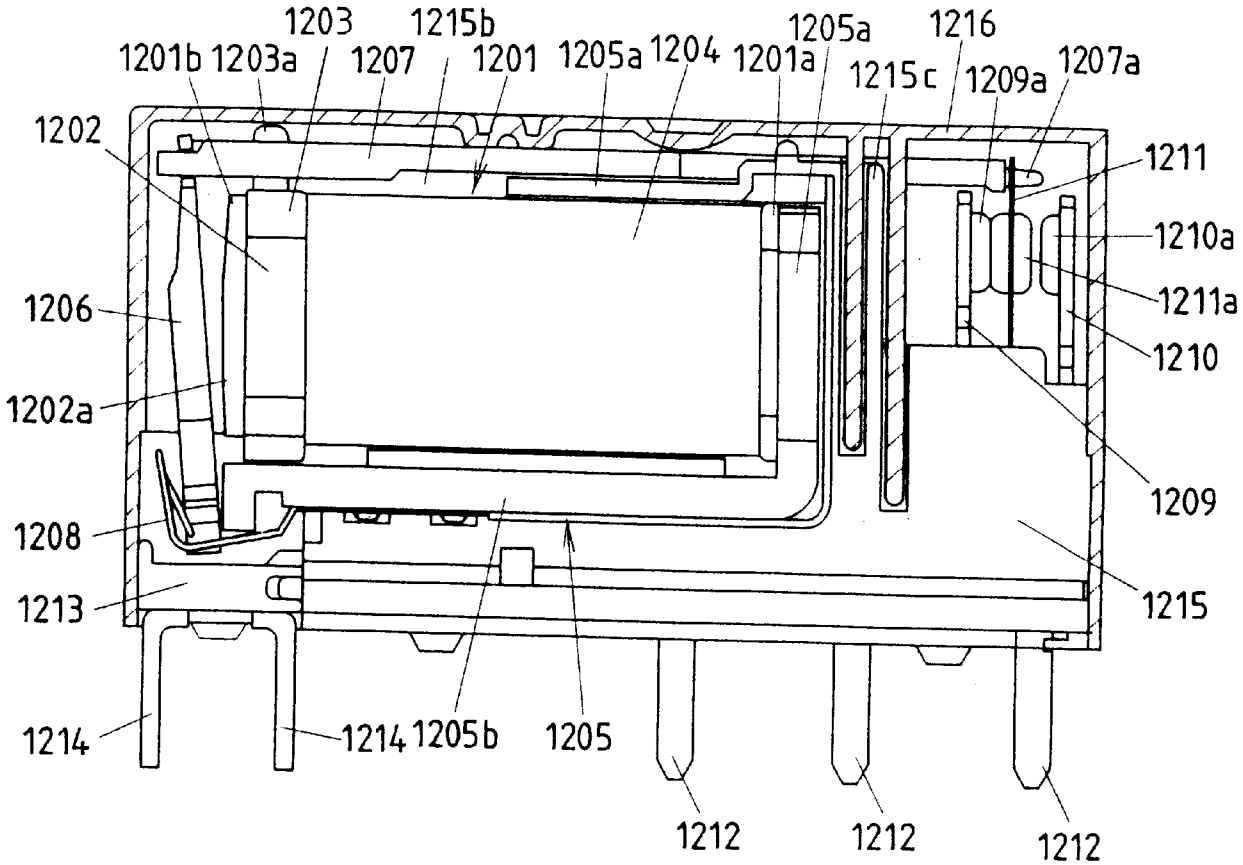
Figure 22A:
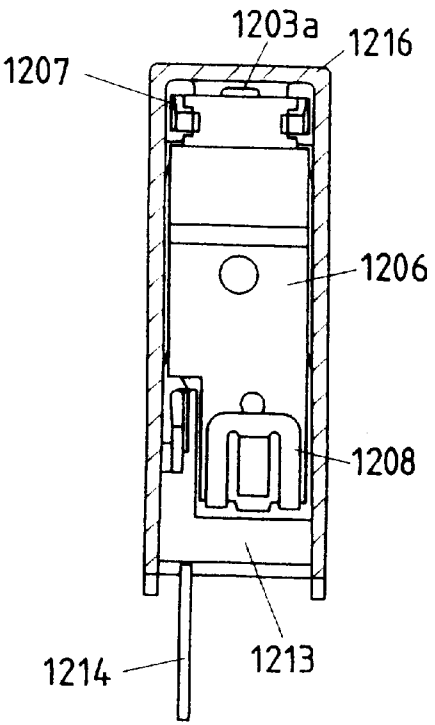
FIGS. 22A and B show an embodiment of the invention.

When in a stationary state, a voltage in excess of a responsive voltage is applied to between the terminals 1214, the armature 1206 attracted to the second magnetic pole 1201*b* of the electromagnet 1201 is rotated about the end of the yoke 1205 while resisting a spring force of the hinge spring 1208 and the movable contact plate 1211, and the card 1207 is translated to the right in FIG. 22B through the rotation of the armature 1206 that is attracted to the second magnetic pole 1201*b* of the electromagnet 1201. And the movable contact plate 1211 is pushed with the end of the card 1207, and turned in the right direction in FIG. 22B. The movable contacts 1211*a* fastened to the movable contact plate 1211 moves apart from the fixed contact 1210*a* on the normally closed side, and comes in contact with the fixed contact 1210*a*. in this say, the movable contact is switched to another contact. When the voltage applied to between the terminals 1214 drops to below a release voltage, the armature 1206 is released from the attraction force by the electromagnet 1201, and is returned to the stationary position with the aid of the spring forces of the armature 1206 and the hinge spring 1208. When the pressing force by the card 1207 disappears, the movable contact plate 1211 is returned to the stationary state. The movable contacts 1211*a* moves apart from the fixed contact 1210a on the normally open side and comes in contact with the nozzle plate 1209 on the normally closed side.

Figure 25A:
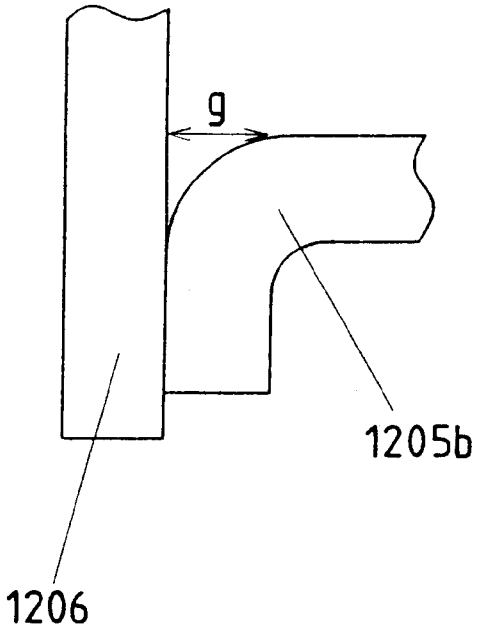
FIGS. 25A and 25B are explanatory diagrams for explaining the embodiment.

A structure of the yoke 1205 which is essential to the present invention will be described. In this embodiment, the end of the lateral portion 1205*b* which comes in contact with the lower end of the armature 1206 and serves as a fulcrum when the armature 1206 is turned, is shaped like L, to thereby increase a contact area between the end of the lateral portion 1205*b* and the lower end of the armature 1206. With this, a magnetic resistance of the contact area where the yoke 1205 and the armature 1206 are in contact with each other is reduced, thereby increasing the attraction force of the electromagnet 1201 to the armature 1206. Further, the yoke 1205 thus structured may be formed by bending an end portion of a plate member of a uniform thickness at about right angle, and is not increased in manufacturing cost unlike the case using the stepped member.

Where the plate member is merely bent, a bending portion of the lateral portion 1205*b* of the yoke 1205 is bent as shown in FIG. 25A. Accordingly, a gap "g" is formed between the armature 6 and the lateral portion 1205*b*.

Figure 25B:
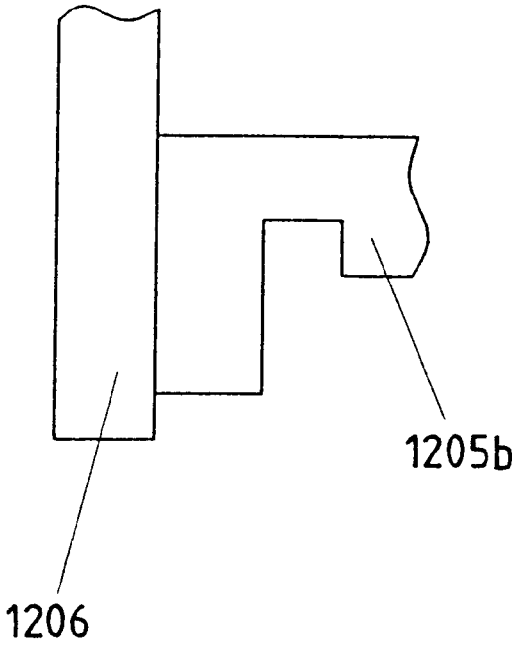
Figures 26A, 26B:
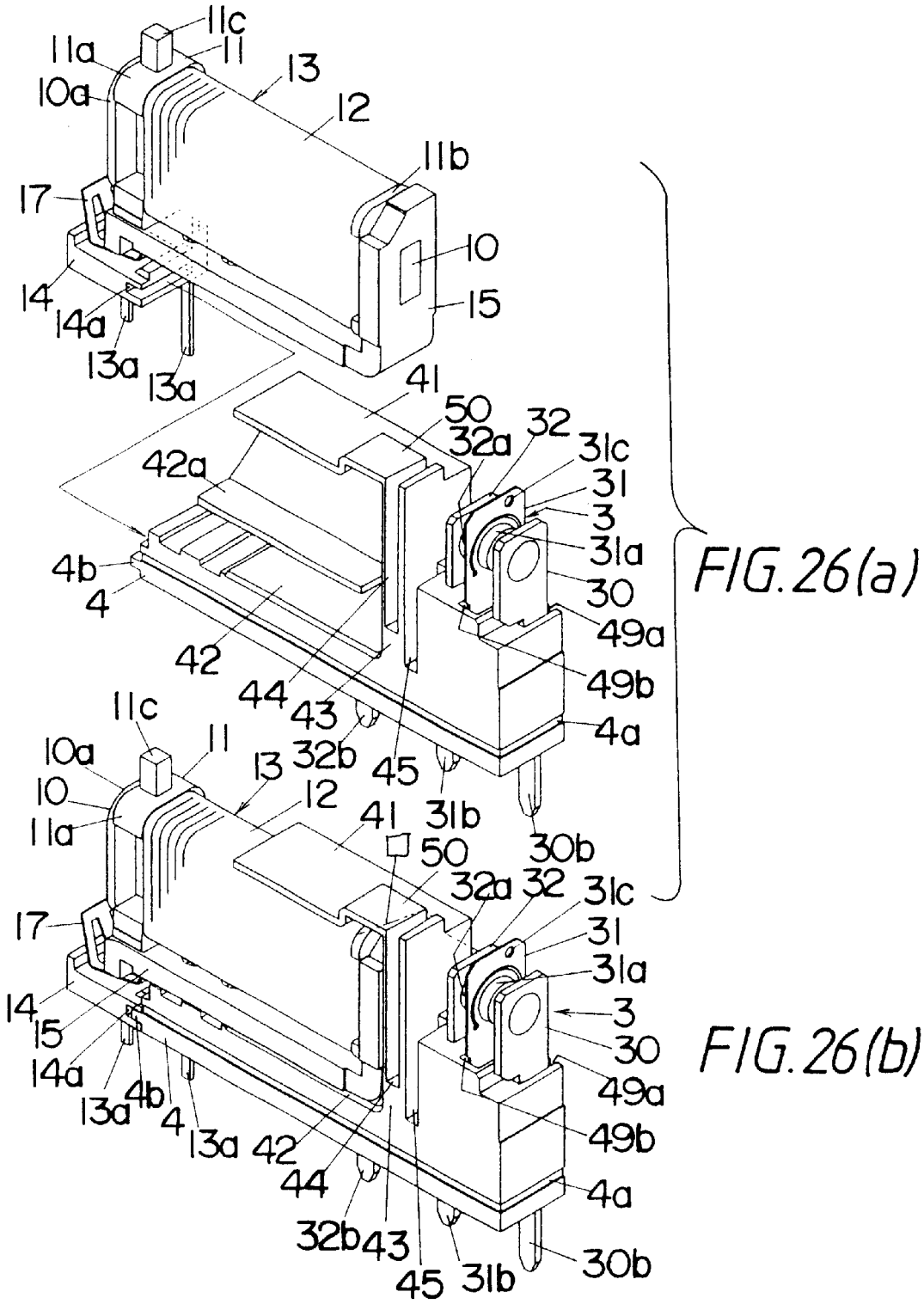
FIGS. 26A and 26B show an electromagnetic relay which is another embodiment of the present invention.
Figure 27B:
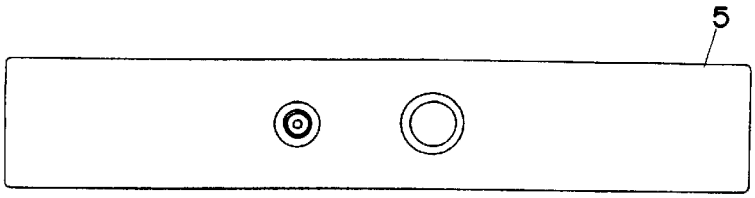
FIGS. 27A, 27B, 27C, and 27D show the electromagnetic relay of the same embodiment.
Figure 27C:
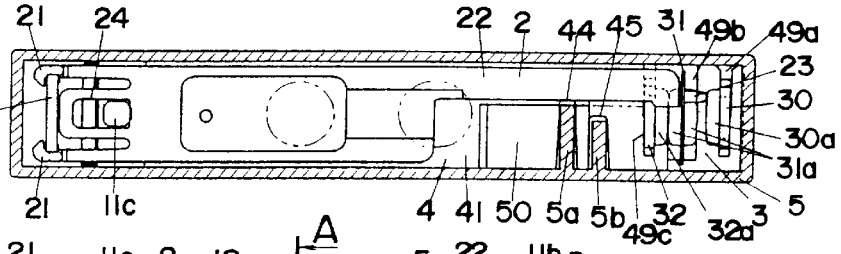
Figure 27A:
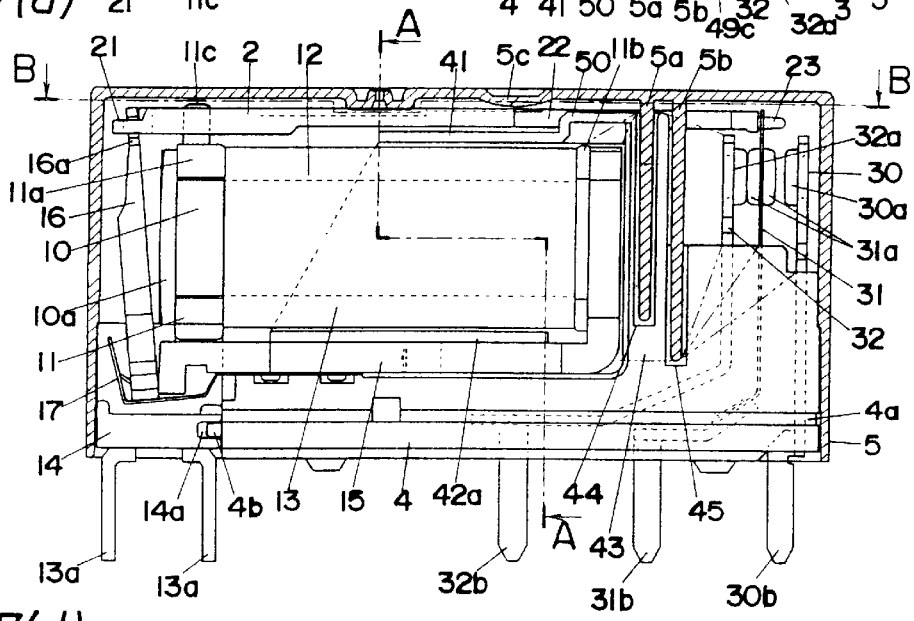
Figure 27D:
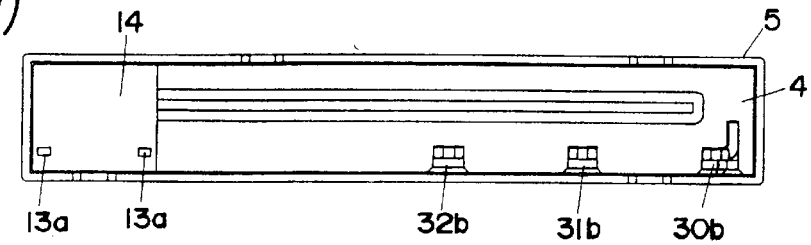
Figure 28:
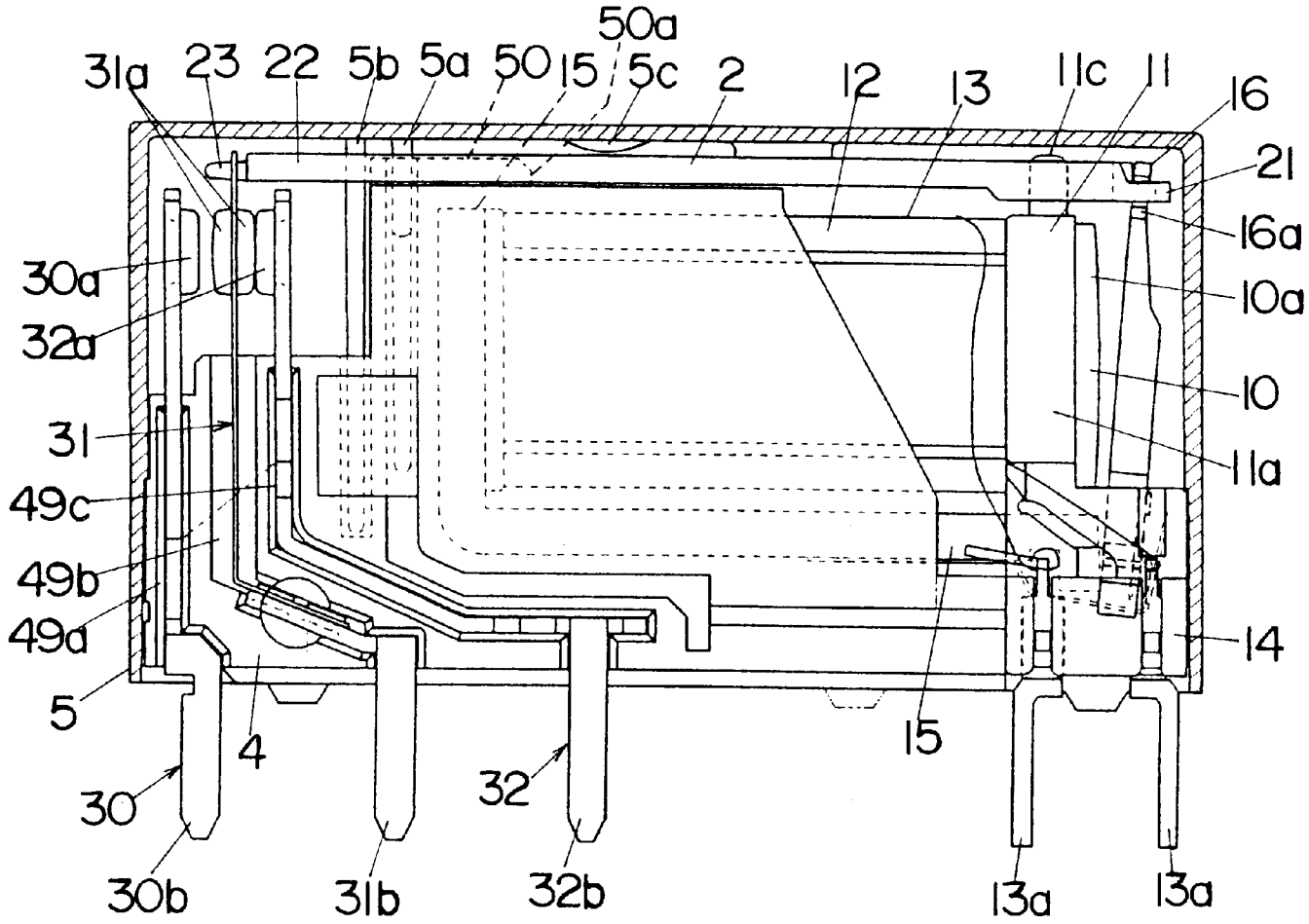
FIG. 28 is a cross sectional view showing the electromagnetic relay of the same embodiment when viewed from the rear side.
Figure 29:
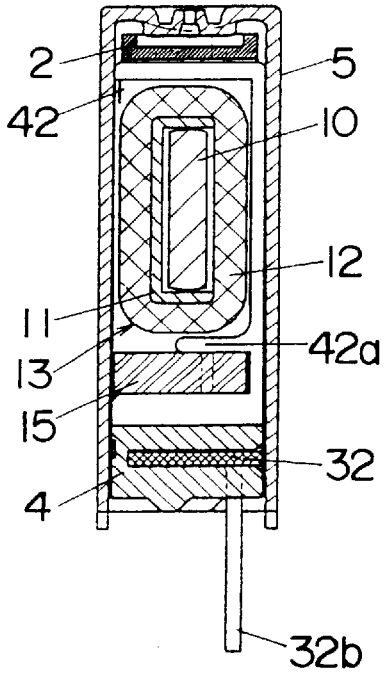
FIG. 29 shows the electromagnetic relay of the same embodiment.
Figures 30A, 30B:
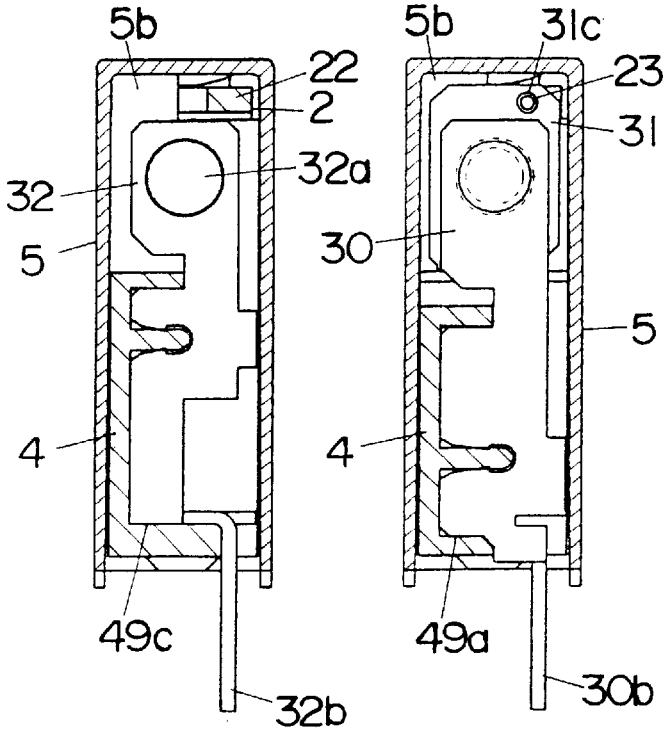
FIGS. 30A and 30B show the electromagnetic relay of the same embodiment.
Figure 31:
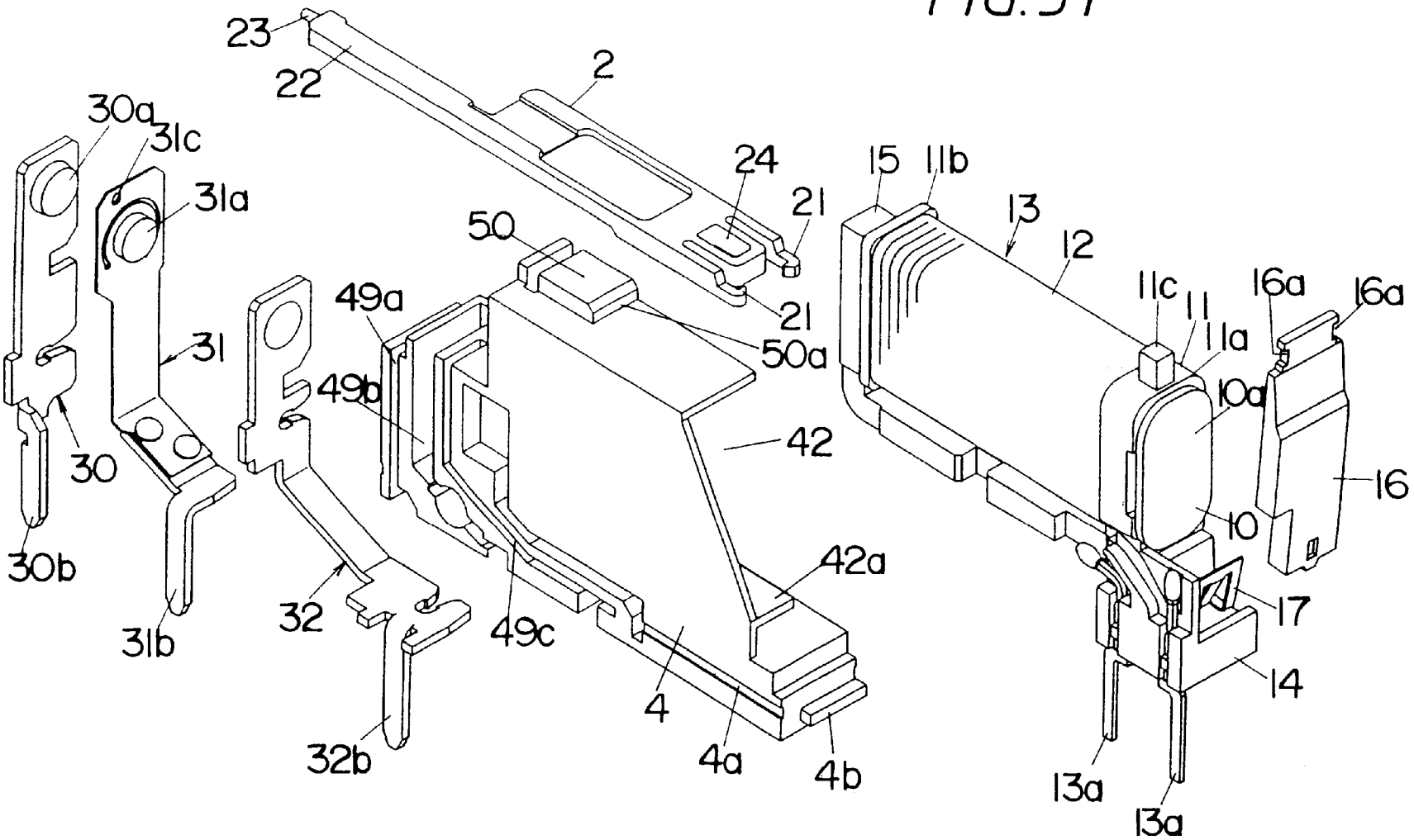
FIG. 31 is a perspective view showing the electromagnetic relay of the same embodiment.
Figure 32:
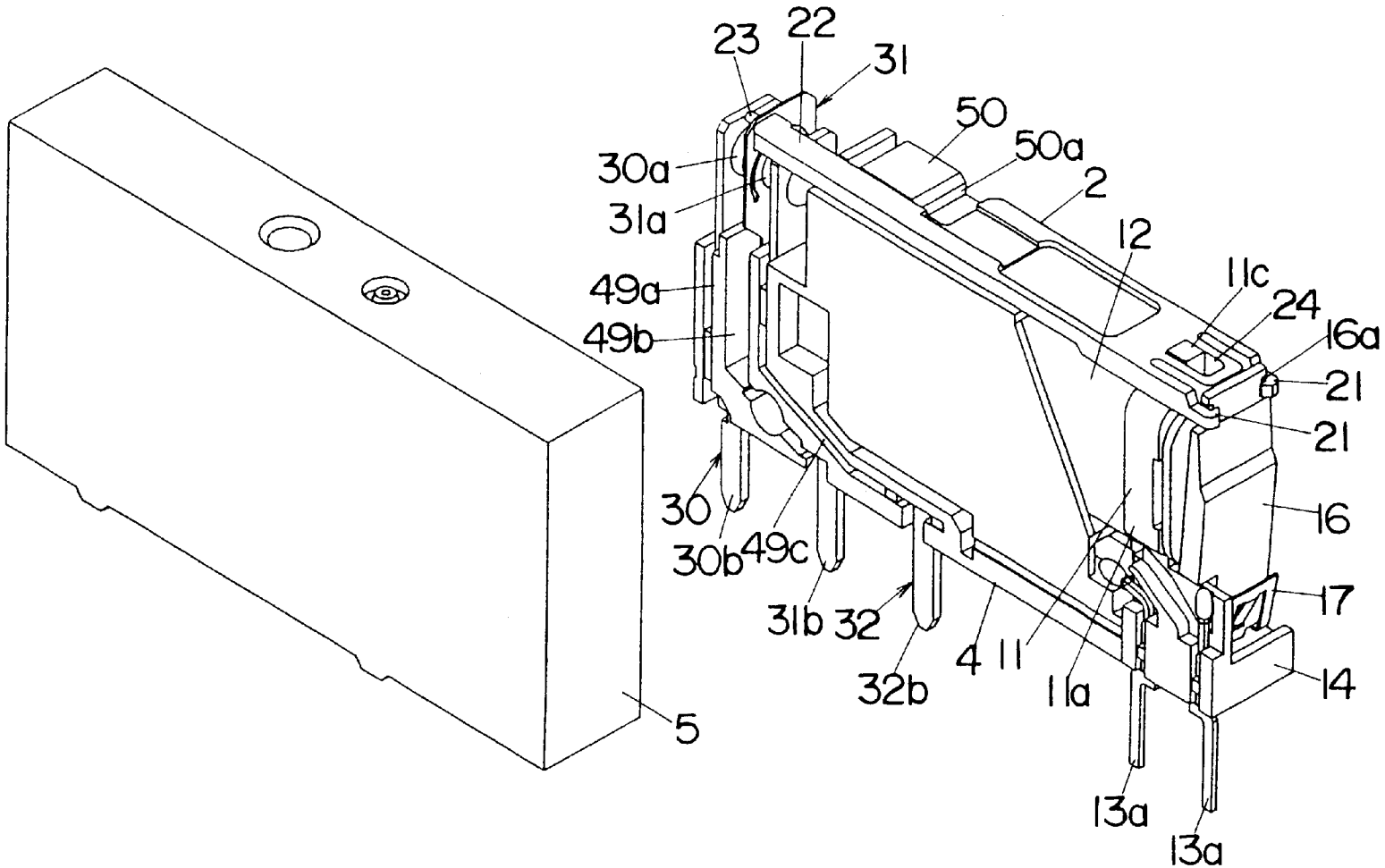
FIG. 32 is a perspective view showing the electromagnetic relay of the same when a cover is removed.
Figure 33:
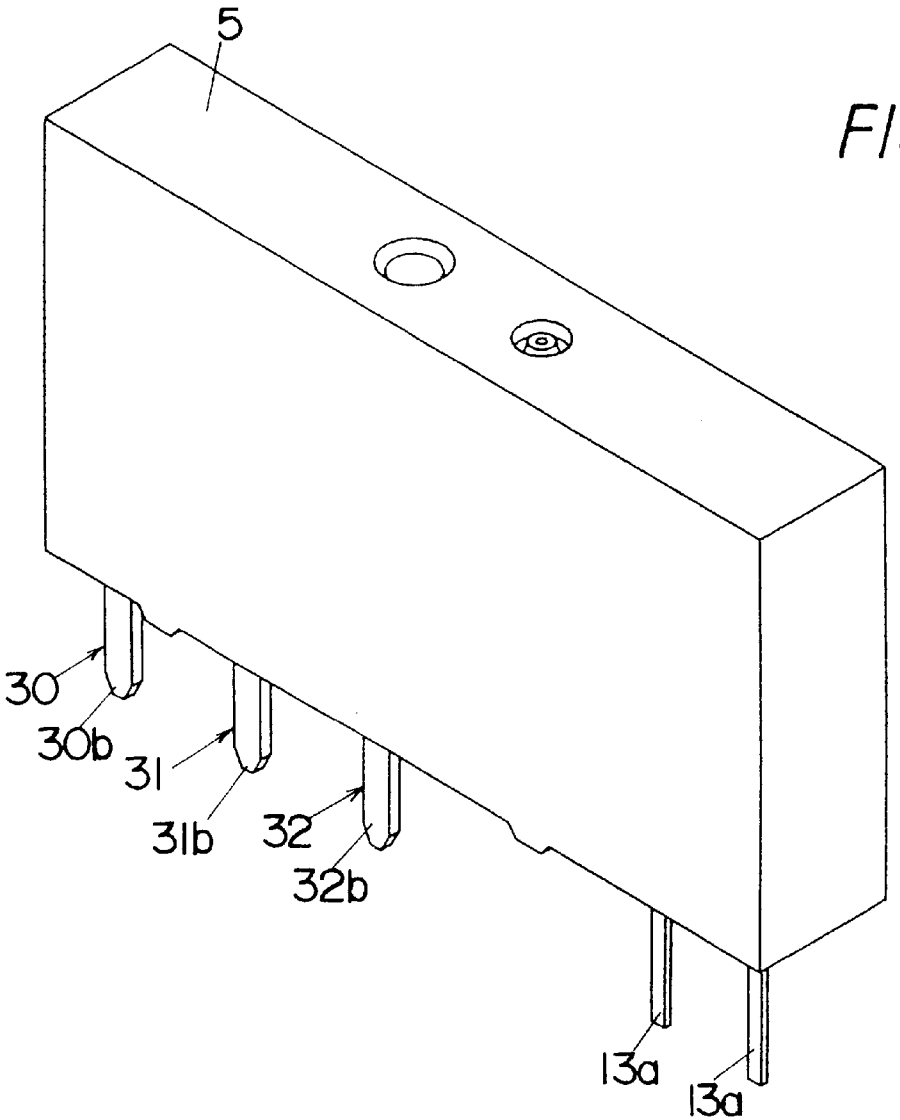
FIG. 33 is a perspective view showing an exterior view of the electromagnetic relay of the same embodiment.
Figures 34, 34B:
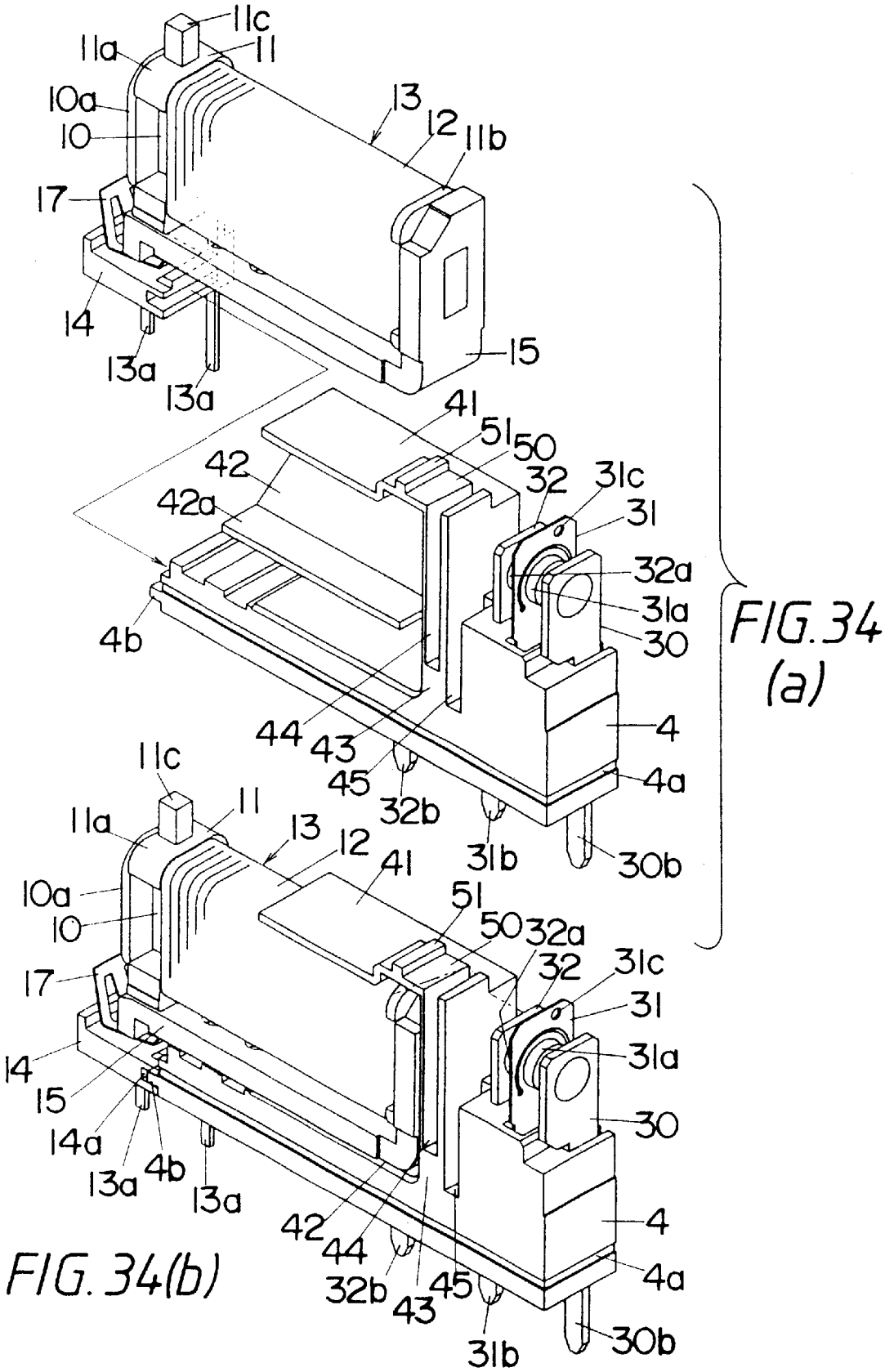
Figure 35B:
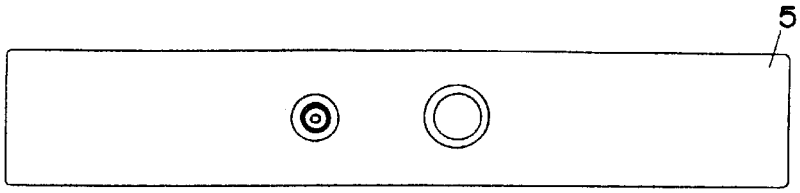
FIGS. 35A, 35B, 35C, and 35D show the electromagnetic relay of the same embodiment.
Figure 35C:
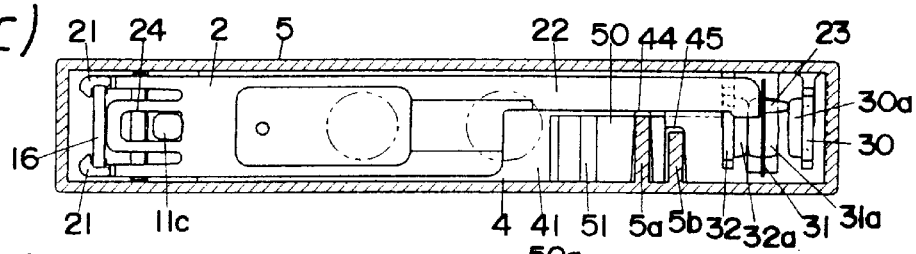
Figure 35A:
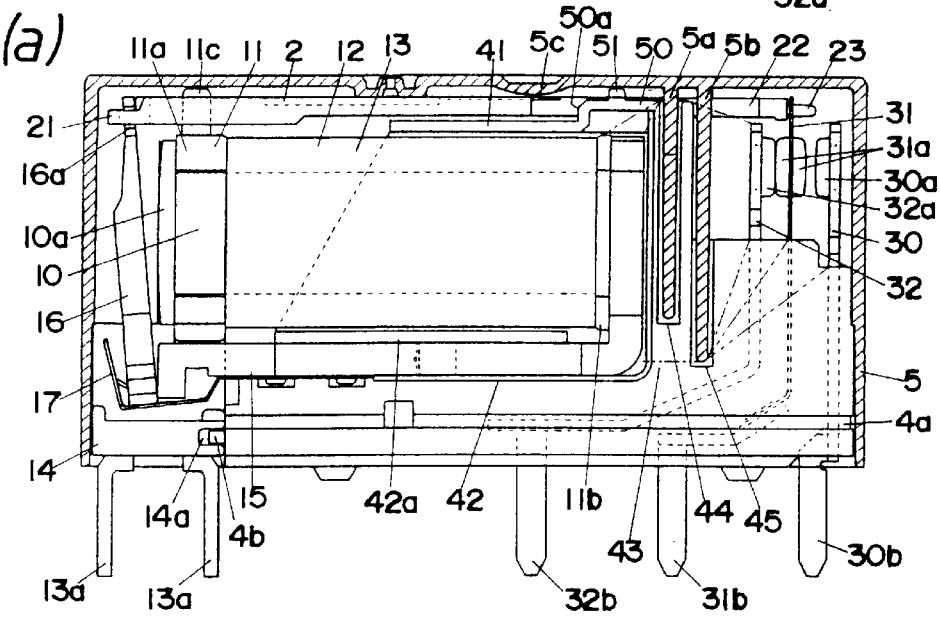
Figure 35D:
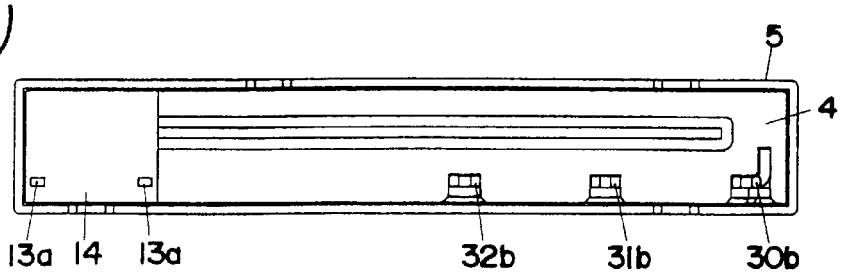
Figure 36:
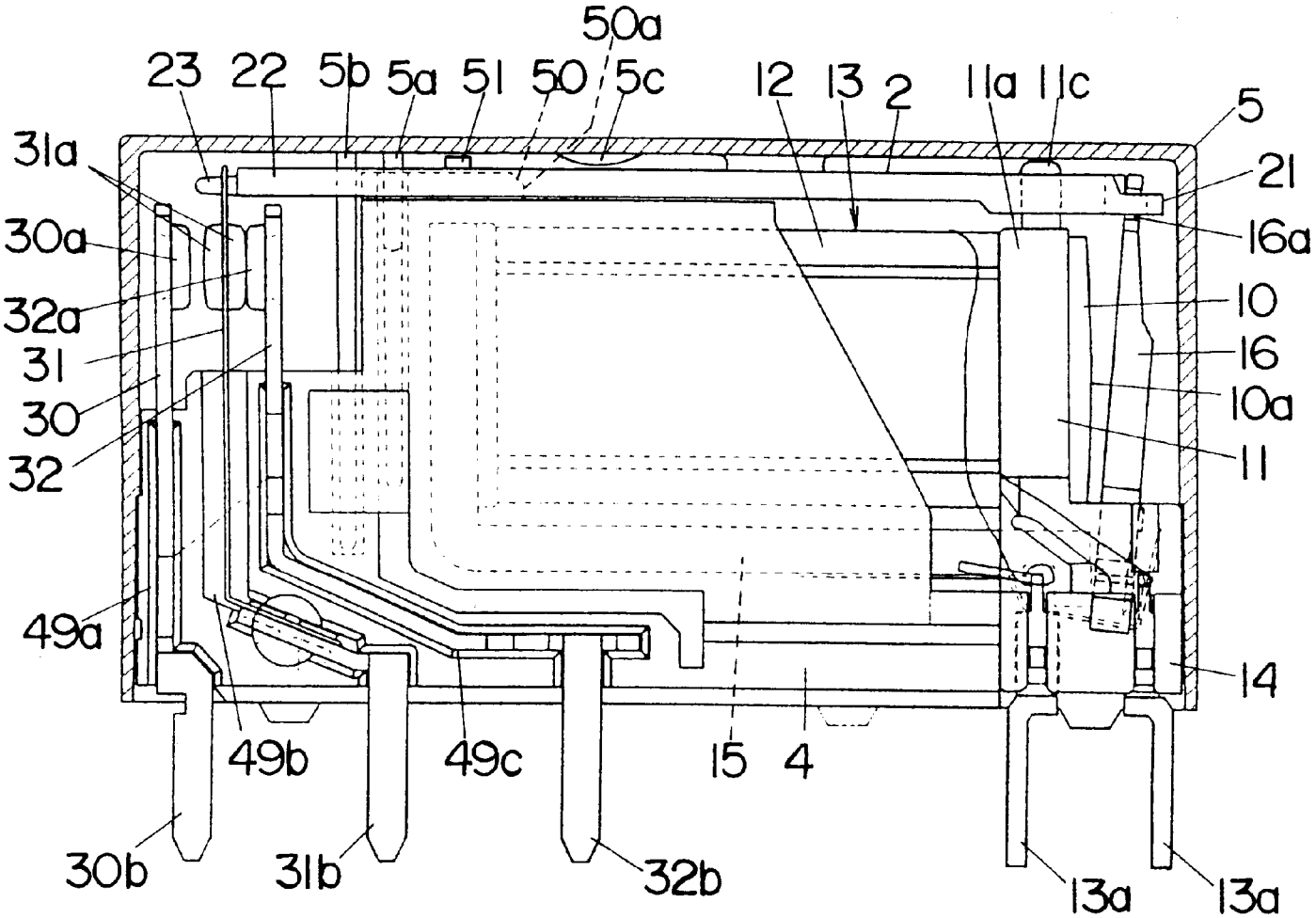
FIG. 36 is a cross sectional view showing the electromagnetic relay of the same embodiment when viewed from the rear side.
Figure 37:
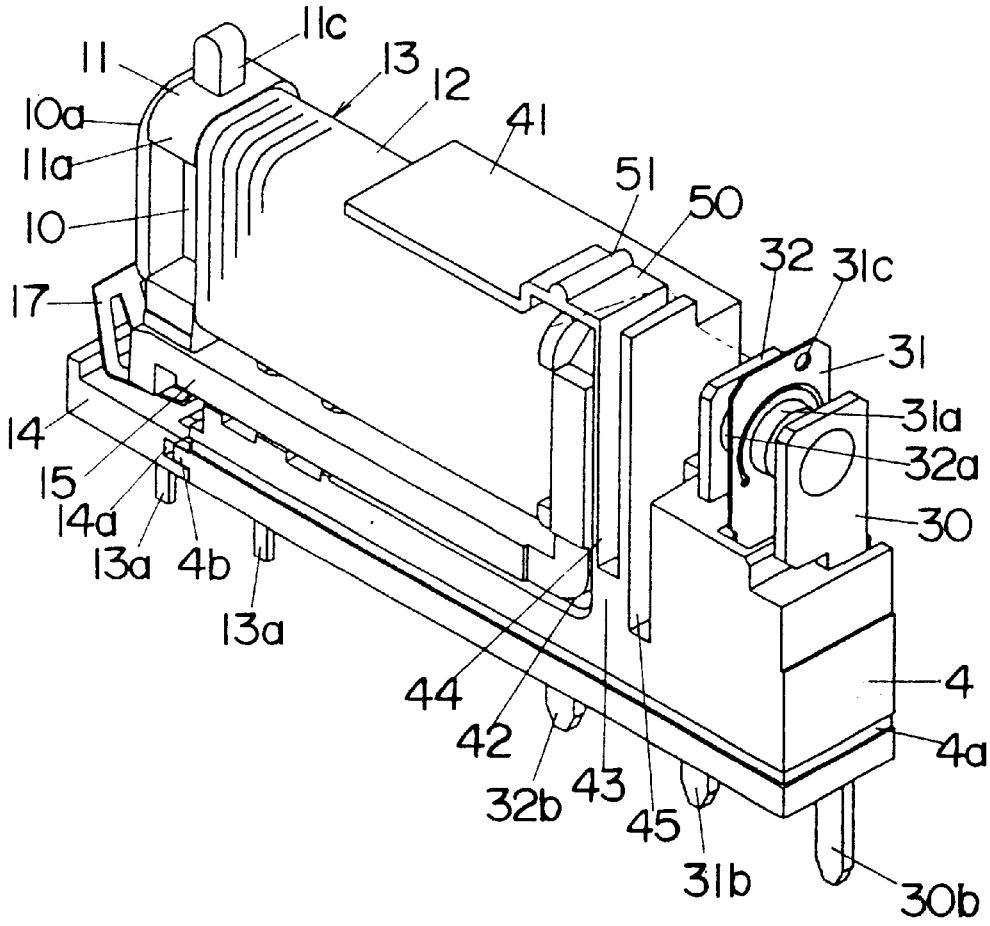
FIG. 37 is a perspective view showing another electromagnetic relay of the same embodiment.

To cope with, when the yoke 1205 is manufactured, the end of the lateral portion 1205*b* is bent at about right angle, and then the bent potion is subjected to a called shaving process. As a result, the bending portion of the lateral portion 1205*b* is sharpened as shown in FIG. 25B to increase a degree of joining between it and the armature 1206, and hence to reduce a magnetic resistance of the contact portion where the yoke 1205 and the armature 1206. Since the yoke 1205 may be made out of the plate member of a uniform thickness, the management of the thick dimensions of the yokes 1205 when those are manufactured is easy.

Insulation and Positioning Structure

The preferred embodiments of the present invention will be descried with reference to FIGS. 26 through 33.

As shown, the electromagnetic relay is made up of electromagnetic block 1 with an armature 16, a card 2, a contact portion 3, a body 4, and a cover 5. The armature 16 of the electromagnetic block 1 is driven when current is fed to a coil thereof. The card 2 is driven through the reciprocal motion of the armature 16 to open and close a contact portion 3 to be described later. The contact portion 3 includes a normally closed contact plate 30, made of conductive material, having a normally open contact 30*a* at an end thereof, a normally open contact plate 32, made of conductive material, having a normally open contact 32*a* at an end thereof, and a movable contact plate 31, made of conductive material, having movable contacts 31*a* on both sides of one end thereof, which the contacts 31*a* may be brought into contact with and separated from the normally open contact 30*a* and the normally open contact 32*a*. The body 4, made of synthetic resin, includes accommodating grooves 49*a* to 49*c* which are located at one end thereof when viewed in the longitudinal direction, contact plates 30 to 32 being placed in the accommodating grooves. The body 4 further includes an accommodating concavity portion 42 which is located at the other end when viewed in the longitudinal direction and opened to the other side when viewed in the width direction, the electromagnetic block 1 being placed in the accommodating concavity portion 42. The cover 5, shaped like a box, is made of synthetic resin, and opened at one side. The body 4 is set covering the electromagnetic block 1, the contact portion 3 and the like.

The electromagnetic block 1 includes a coil block 13, a supporting member 14, a yoke 15 and the armature 16. The coil block 13 is formed with an iron core 10 and a coil 12. A strip-like collar 10*a* as a magnetic pole is formed at one end of the iron core 10 when longitudinally viewed. The coil block 13 includes a coil bobbin 11 and the coil 12. The coil bobbin 11 has collar portions 11*a* and 11*b* located at both ends thereof when longitudinally viewed. The iron core 10 is mounted on the coil bobbin 11. The coil 12 is wound on the coil bobbin 11 while being located between the collar portions 11*a* and 11*b*. The supporting member 14 is integral with the collar portion 11*a* of the coil bobbin 11, which is located closer to the collar 10*a*. The yoke 15 is made of magnetic material and shaped like L. The yoke 15 covers the end face and one side surface of the coil block 13, while being magnetically coupled at one end to the end of the iron core 10, which is opposite to the collar 10*a* thereof. The armature 16 is shaped like a plate. One end of the armature 16 is pivotally supported at the tip of the other end of the yoke 15 by means of a hinge spring 17. The other end of the armature 16 is brought into contact with and separated from the collar 10*a* of the iron core 10. An end of the coil 12 is connected to a terminal 13*a* of the coil block 13. The hinge spring 17 is secured to the tip of the other end of the yoke 15 by caulking or welding, and urges the other end of the armature 16 in a direction in which it moves apart from the collar 10*a* of the iron core 10. A groove 14*a* is formed in the supporting member 14. The groove 14*a* of the supporting member 14 is to be in mesh with a protruded portion 4*b* protruded from the end face of the body 4, which is confronted with the supporting member 14. The tip of the coil terminal 13*a* is protruded from the underside of the supporting member 14.

The normally closed contact plate 30 and the normally closed contact plate 32 are press fit into accommodating grooves 49*a* to 49*c* formed in the body 4 in a state that the normally closed contact plate 30 is located outermost, and the normally open contact 30*a* and the normally open contact 32*a* are disposed in opposition to each other. Terminal pieces 30*b* and 32*b* are provided successively and in an integral fashion at the other ends of the normally closed contact plate 30 and the normally closed contact plate 32. The terminal piece 30*b* and the terminal piece 32*b* are projected from the underside of the body 4. A terminal piece 31*b* is coupled to the other end of the movable contact plate 31. The movable contact plate 31 is fastened to within accommodating groove 49*b* by press fitting the terminal piece 31*b* into accommodating groove 49*b*. At this time, the movable contacts 31*a* formed on both sides of the movable contact plate 31 are confronted with the normally open contact 30*a* and the normally open contact 32*a*, respectively. The terminal piece 31*b* is protruded from the underside of the body 4.

A rib 42*a* is provided on the inner surface of the accommodating concavity portion 42 of the body 4. The rib 42*a* partitions an inner space of the accommodating concavity portion 42 into two spaces. The coil 12 and the yoke 15 are located within two spaces of the accommodating concavity portion 42, respectively, and the electromagnetic block 1 is placed within the accommodating concavity portion 42 in a state that the armature 16 is opposed to the contact portion 3. A groove 4*a* is formed in and along a lower part of the circumferential surface of the body 4. The groove 4*a* prevents sealing compound from creeping up when the electromagnetic relay is sealed by coating the lower surfaces of the body 4 and the supporting member 14 with the sealing compound.

Engaging pawls 21 are provided at one end of the card 2. Those engaging pawls 21 are respectively brought into engagement with depressed parts 16*a*, which are formed in both side edges of the extreme end of the armature 16. A pressing member 22 for pressing the movable contact plate 31 is provided at the other end of the card 2. A protrusion 23 is protruded from the extreme end of the pressing member 22. The protrusion 23 is to be inserted into a hole 31*c* bored in an end of the movable contact plate 31. The engaging pawls 21 of the card 2 are respectively brought into engagement with the depressed parts 16*a*. The protruded piece 23 of the pressing member 22 is inserted into the hole 31*c* of the movable contact plate 31. The card 2 is bridged between the armature 16 and the movable contact plate 31 while being confronted with a wall 41 forming the ceiling of the accommodating concavity portion 42. In this way, the electromagnetic relay is reduced in size and thickness. The width of the pressing member 22 of the card 2 is shorter than the width of the remaining portion thereof. The pressing member 22 of the card 2 is disposed closer to the side of the accommodating concavity portion 42, which is opposite to the closed side thereof. Accordingly, there is no chance that the pressing member 22 interferes with ribs 5*a* and 5*b*, which are protruded from the inner surface of the cover 5. Those ribs will be described later. Further, the pressing member 22 is located apart from the opened side of the accommodating concavity portion 42. Because of this, a creeping distance along the surface of the card 2 between the electromagnetic block 1 and the contact portion 3 is elongated. An elongated hole 24 is formed in a portion of the card 2, which corresponds in position to the collar portion 11*a* of the coil bobbin 11. An engaging protrusion 11*c* protruded from the collar portion 11*a* is inserted into the central band portion 24. The movement direction of the card 2 is stopped by the engaging protrusion 11*c*. A protrusion 5*c* is protruded inwardly of the ceiling of the cover 5. The card 2 may be moved without any shaking when the upper surface of the card 2 slides on the protrusion 5*c* of the cover 5.

In the electromagnetic relay, the contact plate 30 to 32 are disposed on one side of the body 4 when viewed in the width direction, and the electromagnetic block 1 is disposed on the other side. With this structure, a long insulation distance is secured between the contact portion 3 and the electromagnetic block 1, to thereby improve the insulating performance of the electromagnetic relay. Grooves 44 and 45, which are opened to the opening of the accommodating concavity portion 42 are formed in an insulation wall 43 of the contact portion 3 of the accommodating concavity portion 42 and a portion of the body 4, which is located between the insulation wall 43 of the accommodating concavity portion 42 and closer to the contact portion 3. The ribs 5*a* and 5*b* are formed in portions of the inner surface of the cover 5, which corresponds in position to the grooves 44 and 45. Therefore, when the cover 5 is applied to the body 4, the ribs 5*a* and 5*b* of the cover 5 are inserted into the grooves 44 and 45, respectively, so that the insulation wall 43 and the ribs 5*a* and 5*b* doubly insulate the electromagnetic block 1 from the contact portion 3.

A tabular portion 50 having a flat upper surface is raised from a portion of the wall 41 forming the ceiling of the accommodating concavity portion 42, which is located between the electromagnetic block 1 and the contact portion 3. In the structure having the tabular portion 50, a creeping distance (indicated by a one-dot chain line "b" in FIG. 26B) measured along the surface of the wall 41 located between the electromagnetic block 1 and the contact portion 3 is longer than in the structure in which the wall 41 is flat by the height of the tabular portion 50. Therefore, an insulation distance between the electromagnetic block 1 and the contact portion 3 is elongated, thereby improving an insulation performance of the electromagnetic relay. Accordingly, a predetermined insulation distance may be secured by appropriately selecting the shape and the dimensions of the tabular portion 50. A small electromagnetic relay which satisfies the safety standard (spatial distance=8 mm or longer, and creeping distance=8 mm or longer) of VDEO700 prescribed by the Germany Electrical Engineering Association (VDE), can be realized.

Meanwhile, the tabular portion 50 is protruded from the wall 41 forming the ceiling of the accommodating concavity portion 42. An end face 50*a* of the tabular portion 50 is brought into contact with the card 2 to define a movement range of the card 2. The tabular portion 50 has a function of a stopper when it cooperates with the engaging protrusion 11*c* of the engaging protrusion 11*c* at the collar portion 11*a* of the coil bobbin 11 to define the movement range of the card 2.

An operation of the electromagnetic relay will briefly be described. When a current is fed to the coil, the armature 16 is attracted to the collar 10*a* of the iron core 10, and is turned counterclockwise (in FIG. 27A) about the end of the yoke 15 which is opposite to one end thereof. With the turning of the armature 16, the card 2 moves to the right side in FIG. 27A. The pressing member 22 presses the movable contact plate 31 against the normally closed contact plate 30. The movable contacts 31*a* separates from the normally open contact 32*a* and comes in contact with the normally open contact 30*a*. When the current feeding to the coil is stopped, the attraction force disappears, and the armature 16 is turned counterclockwise in FIG. 27A by the returning forces of the movable contact plate 31 and the hinge spring 17. With the turning of the armature 16, the card 2 moves to the left in FIG. 27A. The force of the pressing member 22 to press the movable contact plate 31 toward the normally closed contact plate 30 disappears. Accordingly, the movable contact plate 31 is moved toward the normally closed contact plate 32 by the returning force of the movable contact plate 31, and the movable contacts 31*a* separates from the normally open contact 30*a* and comes in contact with the normally open contact 32*a*.

An electromagnetic relay which is another embodiment of the present invention will be described with reference to FIGS. 34 through 38. Like reference numerals will be used for designating like or equivalent portions in the electromagnetic relay of the previously decried, for simplicity.

The present embodiment is arranged such that in the electromagnetic relay of the previous embodiment, a protrusion 51 is formed on the tabular portion 50 protruded from the wall 41 forming the ceiling of the accommodating concavity portion 42, and that a height dimension of the engaging protrusion 11*c* of the collar portion 11*a* of the coil bobbin 11, which is located opposite to the contact portion 3, is selected so that the tip of the engaging protrusion 11*c* comes in contact with the ceiling of the cover 5. With such an arrangement, when the cover 5 is applied to the body 4, the mounting position of the cover 5 when it is attached to the body 4 by bringing the end faces of the protrusion 51 and the engaging protrusion 11*c* into the ceiling surface of the cover 5. In this sense, the protrusion 51 and the engaging protrusion 11*c* forming a positioning protrusion.

In the electromagnetic relay, the end faces of the protrusion 51 and the engaging protrusion 11*c* are flat. When the protrusion 51 and the engaging protrusion 11*c* are different in height, the corners of those protrusions come in contact with the protrusion 51 and the engaging protrusion 11*c*. As a result, there is a possibility that an inclination of the cover 5 is great. To avoid this, the ends of the protrusion 51 and the engaging protrusion 11*c* when viewed in the direction of the arrangement of the protrusion 51 and the engaging protrusion 11*c* may be shaped like substantially semicircular in cross section while being curved toward the ceiling of the cover 5. In this case, the protrusion 51 and the engaging protrusion 11*c* come in contact with the ceiling surface of the cover 5. Accordingly, an inclination of the cover 5 is reduced when comparing with the structure where the corners of the protrusion 51 and the engaging protrusion 11*c* come in contact with the ceiling of the cover 5. It should be understood that curving those ends toward the ceiling of the cover 5 suffices for avoiding the inclination increase of the cover 5, but it is not essential that the ends of the protrusion 51 and the engaging protrusion 11*c* are shaped like substantially semicircular in cross section when viewed in the direction of the arrangement of the protrusion 51 and the engaging protrusion 11*c*.

Figure 38:
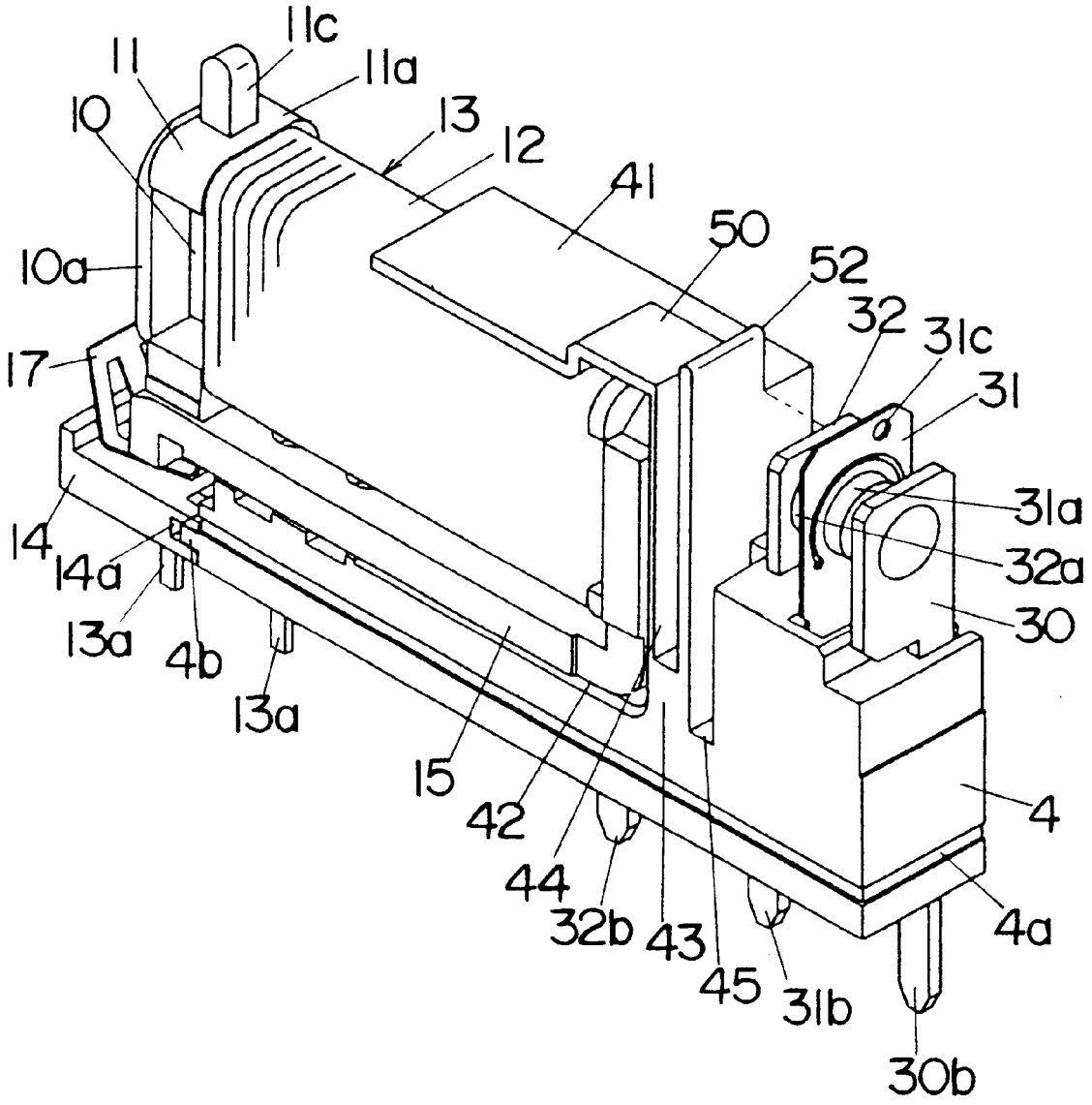
FIG. 38 is a perspective view showing another electromagnetic relay of the same embodiment.

As shown in FIG. 38, a protruded piece 52 which serves as a positioning protrusion and is to be in contact with the ceiling surface of the cover 5, may be formed at the end of the wall 41 forming the ceiling of the accommodating concavity portion 42, which is located closer to the contact portion 3. In this instance, an engaging protrusion 11*c* is provided at the collar portion 11*a* of the coil bobbin 11, which is located in opposition to the contact portion 3. The protruded piece 52 is provided at a portion of the wall 41, which is closer to the normally closed contact plate 32. As a result, a distance between the engaging protrusion 11*c* for supporting the ceiling surface of the cover and the protruded piece 52 is increased. Further, an inclination of the cover 5 with respect to the body 4 is reduced.

According to the present invention, there is provided a first electromagnet fixing structure for fixing a yoke and an iron core in an electromagnetic relay characterized in that a yoke, shaped like L, includes a bent surface portion, a rectangular through hole is formed in the central portion of the bent surface portion, a rod-like iron core is formed which has a cross section larger in the longitudinal direction than the rectangular through hole, a protruded portion of which the end face is somewhat smaller than the through hole is formed at the central portion of one end of the iron core, and the yoke and the iron core are fixed by inserting the protruded portion into the through hole. With provision of the protruded portion having the stepped portions on both sides, it is possible to prevent the iron core from being tilted at the time of the spin press-fitting. As a result, it is possible to prevent the attraction force of the electromagnet from reducing in magnitude. A stable increase of the attraction force of the electromagnet is realized.

The invention provides a second electromagnet fixing structure for fixing a yoke and an iron core in an electromagnetic relay characterized in that a yoke, shaped like L, includes a bent surface portion, a rectangular through hole is formed in the central portion of the bent surface portion, a rod-like iron core is formed which has a cross section somewhat shorter in the longitudinal direction than the rectangular through hole, but somewhat wider than the latter, a protruded portion of which the end face is somewhat smaller than the through hole is formed at the central portion of one end of the iron core, and the yoke and the iron core are fixed by inserting the protruded portion into the through hole.

In the fixing structure of the present invention, the protruded portion with the stepped portions on both the sides thereof are provided on the iron core. Provision of the stepped portions, it is possible to prevent the iron core from being tilted at the time of the spin press-fitting. Further, a degree of the magnetic coupling of the yoke and the iron core since a joining area between the yoke and the iron core is increased. As a result, increase of the attraction force of the electromagnet is realized.

The invention provides a third electromagnet fixing structure for fixing a yoke and an iron core in an electromagnetic relay characterized in that a yoke, shaped like L, includes a rectangular through hole is formed in the central portion of the bent surface portion, a rod-like iron core is formed which has a cross section larger than the rectangular through hole, a protruded portion of which the end face is somewhat smaller than the through hole is formed at the central portion of one end of the iron core, and the yoke and the iron core are fixed by inserting the protruded portion into the through hole.

In the thus constructed electromagnet fixing structure, the protruded portion with the stepped portion therearound is provided on the iron core. Therefore, it is possible to prevent the iron core from being tilted with respect to the yoke and the iron core at the time of the spin press-fitting. As a result, a degree of the magnetic coupling of the yoke and the iron core since a joining area between the yoke and the iron core is increased, and increase of the attraction force of the electromagnet is realized.

The invention provides a fourth electromagnet fixing structure for fixing a yoke and an iron core in an electromagnetic relay characterized in that a yoke, shaped like L, includes a bent surface portion, a rectangular groove is formed in the upper part of the bent surface portion, a rod-like iron core is formed which has a cross section larger than the rectangular groove in the longitudinal direction, a protruded portion of which the end face is somewhat smaller than the rectangular groove is protruded from one end of the iron core, and the yoke and the iron core are fixed by inserting the protruded portion into the rectangular groove.

The joining portion of the yoke and the iron core where the largest magnetic loss occurs has three surfaces, and one surface of the protruded portion of the iron core is separated from the magnetic loss area, and the magnetic loss at the joining portion is reduced. Therefore, an attraction force by the electromagnet is increased.

The invention provides a fifth electromagnet fixing structure for fixing a yoke and an iron core in an electromagnetic relay characterized in that a yoke, shaped like L, includes a bent surface portion, a trapezoidal groove is formed in the upper part of the bent surface portion, the trapezoidal groove being configured such that the width of the groove increases with increase of its depth, a rod-like iron core is formed which has a cross section extending further downward from the bottom of the trapezoidal groove, in addition to the size of the trapezoidal groove, a protruded portion of which the end face is somewhat smaller than the trapezoidal groove is protruded from one end of the iron core, and the yoke and the iron core are fixed by inserting the protruded portion into the trapezoidal groove.

The joining portion of the yoke and the iron core where the largest magnetic loss occurs has three surfaces, and one surface of the protruded portion of the iron core is separated from the magnetic loss area, and the magnetic loss at the joining portion is reduced. Therefore, an attraction force by the electromagnet is increased. Since the trapezoidal groove is trapezoidal in shape, there is no chance that the protruded portion of the iron core slips off from the trapezoidal groove of the yoke.

The invention also provides a method of fixing in an electromagnetic relay a yoke, shaped like L, including a bent surface portion and a rectangular through hole the bent surface portion, and a rod-like iron core having a cross section larger than the rectangular through hole, the iron core including a protruded portion protruded at one end of the iron core, one end of the protruded portion being somewhat smaller than the through hole, a length of the protruded portion being somewhat longer than the through hole, and a flange being formed at the other end of the iron core, the method being characterized in that the yoke and the iron core, while the protruded portion is inserted into the through hole, is fixed, by a press-fitting fixing tool, in a total of five directions of four directions from the outer peripheral directions of the bent surface portion to the inner side, and one direction from the flange to the inner side, and spin press-fitting is applied to the protruded portion of the iron core from aid through hole so as to fill a gap formed between the through hole and the protruded portion.

When the spin press-fitting is carried out, the yoke and the iron core are fixed, by means of the press-fitting fixing tool, in the total of five directions, four directions from the outer peripheral of the bent surface portion to the inner side, and one direction from the flange side to the inner side. The expanding of the bent surface portion is prevented, and formation (leaving) of a gap between the yoke and the iron core is prevented. The management of the protruded portions of the iron core is considerably easy and an accuracy on the dimensional variation of the iron-core protruded portions is improved. As a result, an attraction force by the electromagnet is increased.

The invention provides another method of fixing an electromagnet in an electromagnetic relay, wherein in carrying out the spin press-fitting, the bent surface portion is pressed against the stepped faces of the iron core caused by the protruded portion. This method improves a mechanical coupling between the yoke and the iron core. Accordingly, an attraction force by the electromagnet is increased.

The invention provides another method of fixing an electromagnet in an electromagnetic relay, wherein the iron core is inserted into a cylindrical bobbin with a coil wound thereon before the protruded portion is inserted into the through hole. When this method is used, an electromagnet improved in attraction force is obtained.

As seen from the foregoing description, an electromagnetic relay of the invention comprises: an electromagnet in which a coil is wound around an iron core; a yoke of which one end is magnetically coupled to a first magnetic pole of the electromagnet and the other end is extended to a position near a second magnetic pole of the electromagnet; an armature being rotatably coupled to the other end of the yoke and being driven by the electromagnet; movable contacts being movable with a turn of the armature; and fixed contacts being brought into contact with and separated from the movable contacts; wherein the other end of the yoke serving as a fulcrum when aid armature is turned is bent like L. Since the other end of the yoke is bent like L, a contact area of it where it contacts with the armature is enlarged, thereby increasing the attraction force of the electromagnet to the armature. Further, the yoke may be formed by bending a plate member of a uniform thickness, and hence is not increased in manufacturing cost.

The present invention also provides a method of manufacturing an electromagnetic relay which comprises: an electromagnet in which a coil is wound around an iron core; a yoke of which one end is magnetically coupled to a first magnetic pole of the electromagnet and the other end is extended to a position near a second magnetic pole of the electromagnet; an armature being rotatably coupled to the other end of the yoke and being driven by the electromagnet; movable contacts being movable with a turn of the armature; and fixed contacts being brought into contact with and separated from the movable contacts; wherein the other end of the yoke serving as a fulcrum when aid armature is turned is bent like L, the manufacturing method being characterized in that one end of a plate-like magnetic member is bent, and then the bent potion is subjected to a shaving process, to thereby form the L-shaped end serving as a fulcrum when the armature is turned.

Therefore, the yoke may be made out of the plate member of uniform thickness, so that the management of the thick dimensions of the yokes when those are manufactured is easy. The bent potion of the yoke is sharpened by shaving process, to increase a degree of joining between the other end of the yoke and the armature, and hence to further reduce a magnetic resistance of the contact portion where the yoke and the armature.

As seen from the foregoing description, an electromagnetic relay of the present invention comprises: an electromagnetic block with an armature, which is driven when current is fed to a coil thereof; a contact portion including a fixed contact plate having a fixed contact and a movable contact plate having a movable contact; a card being driven through a reciprocal motion of the armature to open and close the contact portion; and a body in which the contact plates are placed at one end thereof and an accommodating concavity portion being located at the other end while opened sideways, the electromagnetic block being placed in the accommodating concavity portion; wherein protrusion means provided in a portion of a wall forming the ceiling of the accommodating concavity portion, which is located between the electromagnetic block and the contact portion, so as to increase a creeping distance between the electromagnetic block and the contact portion. Therefore, a creeping distance is longer than in a structure having a flat surface by the height of the protrusion means. Further, the insulation performance of the electromagnetic relay is improved, and a satisfactory insulation distance is secured even in a small electromagnetic relay.

Another electromagnetic relay of the invention corresponds to the first electromagnetic relay which further comprises: a cover, shaped like a box, being made of synthetic resin, and opened at 40 one side, and being attached to the body while covering the electromagnetic block and the contact portion, and wherein positioning protrusions are formed on a wall forming the ceiling of the accommodating concavity portion and a collar portion of a coil bobbin with a coil wound thereon. Therefore, when the cover is attached to the body, the positioning protrusion is brought into contact with the ceiling surface of the cover. Therefore, the cover may precisely be positioned to the body. Further, the ceiling surface of the cover is supported at two positions. This leads to stabilization of the mounting of the cover.

Another electromagnetic relay of the present invention specified such that the positioning protrusion being formed on a wall forming the ceiling of the accommodating concavity portion is a protrusion protruded from the protrusion means, and the positioning protrusion protruded from the collar portion and the protrusion protruded from the protrusion means are curved in cross section when viewed in the direction of the arrangement of the protrusions toward the ceiling of the cover. With such a technical feature, in a case where the contact surfaces of the positioning protrusion in contact with the ceiling surface of the cover and the protruded portion are flat, if the height of the positioning protrusion is different from that of the protruded portion, the corners of the positioning protrusion and the protruded portion come in contact with the ceiling surface of the cover. In this case, the positioning protrusion and the protruded portion are in contact with the ceiling of the cover at their curved portions since those are curved in cross section toward the ceiling surface of the cover. Therefore, an inclination of the cover is advantageously reduced. An electromagnetic relay of the present invention specified such that the collar portion of the coil bobbin, which includes the positioning protrusion, is located at one end of the coil bobbin which is opposite to the other end thereof at which the contact portion is provided, and the positioning protrusion being formed on a wall forming the ceiling of the accommodating concavity portion is provided at a portion of the wall closer to the contact portion. With such a technical feature, one positioning protrusion is provided closer to the collar portion which is located at the end of the coil bobbin which is opposite to the end thereof closer to the contact portion. Therefore, a distance between the two positioning protrusions is increased, so that an inclination of the cover with respect to the body is reduced.

What is claimed is:

1. An electromagnet comprising:

a yoke comprising a base portion and a leg portion, said leg portion extending substantially perpendicularly from a first end of said base portion and defining an insertion portion;

a rectangular iron core extending through an electromagnetic coil, said iron core comprising a protrusion extending into said insertion portion for providing a connection between said iron core and said yoke, the connection comprising a gapless mechanical contact between an outer periphery of said protrusion and an inner periphery of said insertion portion; and an armature pivotally supported by a second end of said base portion opposite to said leg portion of said yoke, said armature being magnetically driven by said coil.

2. The electromagnet as claimed in claim 1, said protrusion comprising at least one stepped portion and said insertion portion comprising an insertion hole extending through said leg portion of said yoke.

3. The electromagnet as claimed in claim 2, the at least one stepped portion of said protrusion comprising a stepped portion extending in a lateral direction of a cross-section of said iron core.

4. The electromagnet as claimed in claim 2, the at least one stepped portion of said protrusion comprising a stepped portion extending in a longitudinal direction of a cross-section of said iron core.

5. The electromagnet as claimed in claim 2, the at least one stepped portion of said protrusion comprising a stepped portion extending in a lateral direction and a stepped portion extending in a longitudinal direction of a cross-section of said iron core.

6. The electromagnet as claimed in claim 2, a cross-section of said protrusion having substantially the same size and shape as the inner periphery of said insertion hole.

7. The electromagnet as claimed in claim 1, said protrusion and said iron core comprising a trapezoidal shape and said insertion portion comprising an insertion slot extending through said leg portion.

8. An electromagnet comprising:

an electromagnetic block, comprising:

a yoke comprising a base portion, a leg portion and a contact area, said leg portion extending substantially perpendicularly from one end of said base portion, and said contact area being larger than a cross-section of said base portion by extending substantially perpendicularly from an opposite end of said base portion and in an opposite direction from said leg portion;

a rectangular iron core, said iron core having a coil wound thereon and being connected to said yoke, a connection between said iron core and said yoke comprising a spin-pressed joint;

an armature pivotally supported by and in contact with said enlarged contact area of said yoke, said armature being magnetically driven by said coil and movable through a range of motion;

wherein said leg portion of said yoke is magnetically coupled with a first magnetic pole of said electromagnet and said base portion extends toward a second magnetic pole of said electromagnet; and a contact assembly comprising a fixed contact and a movable contact, wherein said movable contact is movable between a closed position in contact with said fixed contact and an open position spaced a distance away from said fixed contact, the distance being defined by the range of motion of said armature.

9. The electromagnet as claimed in claim 8, further comprising:

a card connected at one end to said armature and at an opposite end to said movable contact, wherein said card drives said movable contact through the range of motion between the open position and the closed position; and a main body comprising a first cavity configured to house said electromagnetic block;

a second cavity configured to house said contact assembly, and a ceiling having an inward protrusion;

wherein said second cavity has an access opening in a direction toward said ceiling and said first cavity has an access opening in a direction perpendicular to the direction of the second cavity access opening.

10. The electromagnet as claimed in claim 9, further comprising:

a cover configured to integrally accommodate and attach to said main body, wherein said first cavity, said second cavity and said card are housed within said cover; and a portioning member configured to maintain a fixed distance between said ceiling of said main body and a ceiling of said cover.

11. The electromagnet as claimed in claim 10, wherein said positioning member comprises at least one of the inward protrusion of said main body ceiling, a protrusion from a flange circumferentially attached to said iron core an end of said base iron core which is opposite to said leg portion of said yoke and an auxiliary protrusion protruding inwardly from the ceiling of said cover.

12. The electromagnet as claimed in claim 11, wherein a top surface of said positioning member is rounded.

13. The electromagnet as claimed in claim 8, said iron core further comprising a protrusion defined by at least one stepped portion provided at an end of said iron core; and said yoke defining an insertion hole extending through said leg portion of said yoke, the spin-pressed joint connection comprising said protrusion extending into and connecting with an inner periphery of said insertion hole.

14. The electromagnet as claimed in claim 13, the at least one stepped portion of said protrusion comprising a stepped portion extending in a lateral direction of a cross-section of said iron core.

15. The electromagnet as claimed in claim 13, the at least one stepped portion of said protrusion comprising a stepped portion extending in a longitudinal direction of a cross-section of said iron core.

16. The electromagnet as claimed in claim 13, the at least one stepped portion of said protrusion comprising a stepped portion extending in a lateral direction and a stepped portion extending in a longitudinal direction of a cross-section of said iron core.

17. The electromagnet as claimed in claim 13, a cross-section of said protrusion having substantially the same size and shape as that of the inner periphery of said insertion hole.

18. The electromagnet as claimed in claim 8, said iron core further comprising a protrusion provided at an end of said iron core, said protrusion and said iron core having a trapezoidal shape; and said yoke defining an insertion slot extending through said leg portion of said yoke, the spin-pressed joint connection comprising said protrusion extending into and connecting with an inner periphery of said insertion slot.

19. An electromagnet comprising:

a yoke, comprising a base portion, a leg portion and a contact area, said leg portion extending substantially perpendicularly from one end of said base portion, and said contact area extending substantially perpendicularly from an opposite end of said base portion and in an opposite direction from said leg portion, thereby being larger than a cross-section of said base portion; and a rectangular iron core, said iron core having a coil wound thereon and being connected to said yoke, wherein the connection between said iron core and said yoke comprises a spin-pressed joint;

an armature pivotally supported by and in contact with said enlarged contact area of said yoke, said armature being magnetically driven by said coil and movable through a range of motion;

a movable contact being movable through a distance defined by the range of motion of said armature; and a fixed contact, wherein said movable contact is movable between a closed position in contact with said fixed contact and an open position not in contact with said fixed contact;

wherein said leg portion of said yoke is magnetically coupled with a first magnetic pole of said iron core and said base portion extends toward a second magnetic pole of said iron core.

20. An electromagnet comprising:

a yoke comprising a base portion and a leg portion, said leg portion extending substantially perpendicularly from one end of said base portion, and said base portion comprising an enlarged contact area disposed on an end of said base portion which is opposite to said leg portion;

a rectangular iron core, said iron core having a coil wound thereon and having a spin-pressed connection with said yoke;

an armature pivotally supported by and in contact with said enlarged contact area of said yoke, said armature being magnetically driven by said coil and movable through a range of motion;

a movable contact being movable through a distance defined by the range of motion of said armature; and a fixed contact, wherein said movable contact is movable between a closed position in contact with said fixed contact and an open position not in contact with said fixed contact;

wherein said leg portion of said yoke is magnetically coupled with a first magnetic pole of said iron core and said base portion extends toward a second magnetic pole of said iron core; and wherein said enlarged contact area being in one piece with said base portion, said base portion being extended at an angle of about ninety degrees to form said enlarged contact area and said enlarged contact area being configured to define a perpendicular corner at a juncture of said enlarged contact area and said base portion.

21. An electromagnet comprising:

a yoke a base portion and a leg portion, said leg portion extending substantially perpendicularly from a first end of said base portion and defining an insertion hole, and said base portion comprising a contact area, said contact area extending substantially perpendicularly from a second end of said base portion in a direction opposite to the extension of said leg portion;

a rectangular iron core, said iron core comprising a protrusion at one end and extending through an electromagnetic coil, said protrusion extending through said insertion hole, and an outer periphery of said protrusion connecting with an inner periphery of said insertion hole;

an armature pivotally supported at said contact area, said armature being magnetically driven by said coil and movable between an energized position touching said contact area and a neutral position not touching said contact area;

a contact assembly comprising a fixed contact and a movable contact, wherein said movable contact is movable between a closed position in contact with said fixed contact and an open position not in contact with said fixed contact; and a card connected at one end to said armature and at an opposite end to said movable contact, wherein said card drives said movable contact so that the closed position and the open position of said movable contact correspond to the energized position and the neutral position of said armature, respectively;

wherein the connection between the outer periphery of said protrusion and the inner periphery of said insertion hole comprises a gapless mechanical contact, thereby increasing electrical conductivity; and wherein said contact area of said base portion extends for a distance that is longer than a width of said base portion, thereby increasing electrical conductivity.

22. An electromagnet comprising:

a yoke comprising a base portion and a leg portion, said leg portion extending substantially perpendicularly from a first end of said base portion and defining an insertion portion;

a rectangular iron core extending through an electromagnetic coil, said iron core comprising a protrusion extending into and providing a connection with said insertion portion, the connection comprising a spin-pressed joint; and an armature pivotally supported by a second end of said base portion opposite to said leg portion of said yoke, said armature being magnetically driven by said coil.

23. The electromagnet as claimed in claim 22, said protrusion comprising at least one stepped portion and said insertion portion comprising an insertion hole extending through said leg portion of said yoke.

24. The electromagnet as claimed in claim 22, said protrusion and said iron core comprising a trapezoidal shape and said insertion portion comprising an insertion slot extending through said leg portion.

* * * * *